US006246956B1

(12) United States Patent
Miyoshi et al.

(10) Patent No.: US 6,246,956 B1
(45) Date of Patent: Jun. 12, 2001

(54) VEHICLE TRAFFIC CONTROL APPARATUS

(75) Inventors: Miyako Miyoshi, Ichikawa; Yuji Fujiwara, Koganei; Toshihiro Koyama, Iruma-gun; Kizo Nagashima, Kawasaki; Yoshikazu Oba; Yoshiro Seki, both of Fuchu, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/410,027

(22) Filed: Oct. 1, 1999

(30) Foreign Application Priority Data

Oct. 2, 1998 (JP) ..... 10-281470

(51) Int. Cl.[7] ..... G08G 1/123

(52) U.S. Cl. ..... 701/117; 701/20; 246/182 R

(58) Field of Search ..... 701/117, 19, 20, 701/118, 119, 301, 213; 246/182 R, 167 R, 122 R, 3, 6; 340/903, 905

(56) References Cited

U.S. PATENT DOCUMENTS 5,758,848 * 6/1998 Beule ..... 246/182 B
6,135,396 * 10/2000 Whifield et al. ..... 246/182 R

OTHER PUBLICATIONS

T. Kobayashi, et al., pp. 549–550, "Research of New Train Route Control Method in Station Yard Traffic Control System "Atacs" Based on Information Technologies", Jul. 28, 1997.

K. Iwata, 2 pages, "Advance Safety Analysis for Train Control System Carat by Radio", Dec. 15, 1998.

* cited by examiner

*Primary Examiner*—Tan Nguyen
(74) *Attorney, Agent, or Firm*—Oblon, Spivak, McClelland, Maier & Neustadt, P.C.

(57) ABSTRACT

A vehicle traffic control apparatus includes a vehicle location detection unit for detecting the locations of vehicles within a track, a track monopolized state control unit for storing and controlling the monopolized state of the track which is monopolized by the vehicles, an allocation request unit for requesting allocation of a dynamic monopolized section as a range, in which each vehicle can freely run in both inbound and outbound directions, on the basis of the locations of the vehicles which are detected by the vehicle location detection unit, and an allocation unit for collating the allocation of the dynamic monopolized section to each vehicle with the track monopolized state control unit, executing actual allocation of dynamic monopolized sections on the basis of a collation result, and causing the track monopolized state control unit to store the allocation result. The allocated dynamic monopolized section is transferred from a ground/vehicle transfer unit to each vehicle, and a vehicle speed control unit performs speed control on each vehicle.

28 Claims, 15 Drawing Sheets

TRAIN D WANTS TO ENTER SIDING
(PARTIAL ACCEPTANCE)

TRAIN D HAS ACQUIRED ALL REQUEST RANG OF RUNNING RIGHT → TRAIN D PREPARES FOR RUNNING REMAINING SECTION

TRAIN D HAS ALSO ACQUIRED RUNNING RIGHT TO ENTER SIDING

EXAMPLE OF TRACK MONOPOLIZED STATE CONTROL TABLE
(INCLUDING VEHICLE LOCATION TABLE)

| TRACK NAME | START POINT OF MONOPOLIZED SECTION | | TRACK NAME | END POINT OF MONOPOLIZED SECTION | MONOPOLIZING OBJECT |
|---|---|---|---|---|---|
| PLATFORM 1 OF STATION A | 123.45m | ~ | LINE A | 210.12m | TRAIN K |
| LINE A | 210.12m | ~ | LINE A | 323.23m | TRAIN K |
| PLATFORM 2 OF STATION B | 412.34m | ~ | LINE A | 523.45m | TRAIN L |
| | ⋮ | | | | |
| LINE B | 345.67m | ~ | LINE B | 350.34m | FALLEN STONE P |
| | ⋮ | | | | |
| LINE B | 811.22m | ~ | LINE B | 988.77m | CONSTRUCTION A |
| | ⋮ | | | | |

FIG.8

EXAMPLE OF BRANCH DEVICE MONOPOLIZED STATE CONTROL TABLE
(INCLUDING BRANCH DEVICE MONOPOLIZED STATE TABLE)

| BRANCH DEVICE NUMBER | BRANCH DEVICE NAME | OBJECT THAT HAS ACQUIRED EXCLUSIVE RIGHT | DIRECTION |
|---|---|---|---|
| 1 | TOKYO 58A | TRAIN C | OPPOSITE |
| 2 | TOKYO 58B | TRAIN C | OPPOSITE |
| 3 | TOKYO 54 | NULL | |
| 4 | TOKYO 56 | NULL | |
| ⋮ | ⋮ | | |

FIG. 10A

BRANCH DEVICE STATE TABLE

| BRANCH DEVICE NUMBER | BRANCH DEVICE NAME | DIRECTION | FIXED/FREE |
|---|---|---|---|
| 1 | TOKYO 58A | OPPOSITE | FIXED |
| 2 | TOKYO 54 | HALFWAY | FREE |
| 3 | | | |

FIG. 10B

VEHICLE TRAFFIC CONTROL APPARATUS

BACKGROUND OF THE INVENTION

The present invention relates to a vehicle traffic control apparatus for performing running control and traveling control on vehicles (including trains, monorails, automobiles, buses, and trucks) in a train railway system, new traffic system, or the like and, more particularly, to a vehicle traffic control apparatus which can attain increases in running density and efficiency of vehicles and a reduction in cost while ensuring safety by preventing vehicle-vehicle collision, vehicle-vehicle contact, bumping, derailment, turnover, and the like.

A train running control system in current railroads is basically a block system based on train location detection by means of track circuits using rails and train traveling control using signals. The closed system is designed to prevent a collision between trains by allowing only one train in a given section (one block-one train).

Likewise, in a railroad station, to allow each train to enter a corresponding platform, an interlock control device controls a branch device installed at a branch point of the track and also controls a signal for controlling the movement of the train.

The running density of trains, however, depends on the length of the above block. In order to increase the running density, therefore, ground-based equipment such as track circuits and ground-based signals must be reformed. This requires a great deal of expense and effort.

In addition, one track-one train control is performed in a railroad station. In increasing the running density, therefore, increases in expense and effort with addition of signals pose a problem.

In general, ground-based equipment demands maintenance along a railroad, and a reduction in this maintenance cost presents a significant technical challenge to railroad management.

Furthermore, if the equipment cannot be placed optimally owing to the conditions of location, complicated control logic is required to ensure safety running of trains. This may make it difficult to realize safety control.

BRIEF SUMMARY OF THE INVENTION

It is an object of the present invention to provide a vehicle traffic control apparatus which can realize high-density, efficient vehicle running operation with a reduction in cost while securing safety by preventing accidents between stations and within stations, e.g., vehicle-vehicle collision, vehicle-vehicle contact, bumping, derailment, turnover, railroad crossing disasters, and also preventing accesses of trains to no-accessing sections in a running system for vehicles that run on a track, e.g., a train railway system or new traffic system.

According to the first aspect of the present invention, there is provided a vehicle traffic control apparatus which performs running control and traveling control on vehicles that run on a track, comprising a vehicle location detection unit which detects locations of the vehicles within the track, a track monopolized state control unit for storing and controlling a monopolized state of the track, a dynamic monopolized section allocation request unit which requests allocation of a dynamic monopolized section as a range in which each vehicle can freely run in both inbound and outbound directions on the basis of the locations of the vehicles which are detected by the vehicle location detection unit, a dynamic monopolized section allocation unit which inquires of the track monopolized state control unit as to the allocation of the dynamic monopolized section to each vehicle, which is requested by the allocation request unit, to perform collating operation, the allocation unit executing actual allocation of dynamic monopolized sections on the basis of a collation result, causing the track monopolized state control unit to store an allocation result, and outputting the allocation result, a ground/vehicle transfer unit which transfers the dynamic monopolized sections allocated by the dynamic monopolized section allocation unit to the respective vehicles, and a vehicle speed control unit which performs speed control on the vehicles in accordance with the allocated dynamic monopolized sections transferred by the ground/vehicle transfer unit.

In the vehicle traffic control apparatus according to the first aspect of the present invention, running sections are uniquely allocated to the vehicles to prevent collisions such as vehicle/vehicle bumping. This allows the respective vehicles to run with safety.

In addition, as the vehicles run, exclusive rights to portions of the dynamic monopolized sections which are located behind the respective vehicles are automatically deallocated to sequentially update the sections monopolized by the vehicles. This makes it possible to perform flexible running control on the respective vehicles.

According to the second aspect of the present invention, there is provided a vehicle traffic control apparatus which performs running control and traveling control on vehicles that run on a track having a branch, comprising a vehicle location detection unit which detects locations of the vehicles on the track, a branch device state control unit which controls a joining direction of a branch device installed at a branch point on the track and a state of the branch device whose direction is being changed or fixed, a track/branch device monopolized state control unit which stores and controls a monopolized state of the track and a monopolized state of the branch device, a dynamic monopolized section allocation request unit which requests allocation of a dynamic monopolized section as a range in which each vehicle can freely run in both inbound and outbound directions and allocation of the branch device on the basis of the locations of the vehicles, which are detected by the vehicle location detection unit, and the state of the branch device, which is controlled by the branch device state control unit, a dynamic monopolized section allocation unit which inquires of the track/branch device monopolized state control unit as to the allocation of the dynamic monopolized section and the branch device to each vehicle, which is requested by the dynamic monopolized section allocation request unit, to perform collating operation, the allocation unit executing actual allocation of a dynamic monopolized section and branch device to each vehicle on the basis of a collation result, causing the track/branch device monopolized state control unit to store an allocation result, and outputting the allocation result, a ground/vehicle transfer unit for transferring the dynamic monopolized sections allocated by the dynamic monopolized section allocation unit to the respective vehicles, a vehicle speed control unit which performs speed control on the vehicles in accordance with the allocated dynamic monopolized sections transferred by the ground/vehicle transfer unit, and a branch device control unit which changes and fixes a joining direction of the branch device allocated by the dynamic monopolized section allocation unit.

In addition to the same effects as those of the first aspect, the vehicle traffic control apparatus according to the second aspect of the present invention has the following effect. Even a track having a branch is uniquely allocated to a vehicle when the direction of the branch device is to be changed and the vehicle is to pass through it, and the vehicle is made to run after the direction of the branch device is changed and fixed. This prevents the vehicle from colliding with another vehicle face to face or side to side, derailing, and turning over, and can ensure safety running.

According to the third aspect of the present invention, the vehicle traffic control apparatus according to the first or second aspect further comprises a running diagram input unit which inputs a vehicle running diagram, and the dynamic monopolized section allocation request unit determines an allocation request range of a dynamic monopolized section by using the vehicle running diagram input by the running diagram input unit.

In the vehicle traffic control apparatus according to the third aspect, since allocation of dynamic monopolized sections is requested with reference to the running diagram of vehicles, not only the running plan of a self-train but also the running plans of other trains can be considered. Even in a normal state or in case of a traffic jam, accident, or the like, efficient vehicle running can be performed.

According to the fourth aspect, the vehicle traffic control apparatus according to the first or second aspect further comprises a deallocation request unit which determines a range of a dynamic monopolized section located behind each vehicle and deallocated as the vehicle runs, together with a deallocation timing, on the basis of the location of each vehicle which is detected by the vehicle location detection unit, the deallocation request unit requesting the dynamic monopolized section allocation unit to deallocate the dynamic monopolized section when an initial running plan is changed because of an accident.

In the vehicle traffic control apparatus according to the fourth aspect, since exclusive rights to dynamic monopolized sections of trains are canceled not only sequentially but also in predetermined cycles after the trains run, the apparatus can be simplified.

In addition, since the allocation of dynamic monopolized sections for running can be canceled when a running plan changes, efficient vehicle running can be realized.

According to the fifth aspect of the present invention, in the vehicle traffic control apparatus according to the fourth aspect, the dynamic monopolized section deallocation request unit sets a timing of deallocating a dynamic monopolized section to be the same as a timing of requesting allocation of a dynamic monopolized section.

In the vehicle traffic control apparatus according to the fifth aspect of the present invention, since dynamic monopolized section allocation and deallocation requests are generated at the same timing, the load of ground/vehicle transfer is reduced, and the apparatus can be simplified.

According to the sixth aspect of the present invention, in the vehicle traffic control apparatus according to the first or second aspect, the vehicle speed control unit has a function of forming a deceleration curve from an end position of a dynamic monopolized section (end point of a vehicle in a running direction) to a start position of the dynamic monopolized section in consideration of performance of the vehicle and linearity of a track, and automatically adjusting a speed of the vehicle so as to make the vehicle decelerate along the deceleration curve.

In the vehicle traffic control apparatus according to the sixth aspect of the present invention, in controlling the speeds of vehicles, deceleration curves are formed, and the speeds of the vehicles are controlled in accordance with the deceleration curves.

This makes it possible to stop the vehicles with safety without making them overrun the dynamic monopolized sections.

According to the seventh aspect of the present invention, the vehicle traffic control apparatus according to the first or second aspect further comprises a vehicle location error correction unit which detects locations of depots scattered on the track, measures an error between the detected located and an actual location, and corrects the location of the vehicle which is detected by the vehicle location detection unit.

In the vehicle traffic control apparatus according to the seventh aspect, since an error in the detected vehicle location is corrected by using the location detection error between the detected location of a fixed object and the absolute value, the vehicle location detection precision improves. As a consequence, the margin distance can be decreased, and the running density of vehicles can be increased.

According to the eighth aspect of the present invention, the vehicle traffic control apparatus according to the first or second aspect further comprises a dynamic monopolized section manually setting unit for manually setting a section to which accesses of vehicles are to be inhibited.

In the vehicle traffic control apparatus according to the eighth aspect, a given range on a track can be separated from a running system by setting this range as a section to which the accesses of vehicles are inhibited.

According to the ninth aspect of the present invention, in the vehicle traffic control apparatus according to the first or second aspect, the dynamic monopolized section allocation unit performs allocation in consideration of not only dynamic monopolized sections that have already been allocated to other vehicles but also information from a running obstacle detector, railroad crossing control device, and rail closing control device, which are arranged along a railroad, such as an amount-of-rainfall detector, fallen stone detector, and obstacle detector.

In the vehicle traffic control apparatus according to the ninth aspect, since permission/inhibition of the access of each vehicle is determined by allocating a dynamic monopolized section in this manner, the train running control system including these detectors can be implemented in a simple form.

According to the 10th aspect of the present invention, in the vehicle traffic control apparatus according to the first or second aspect, the dynamic monopolized section allocation request unit sets a maximum allocation request range of a dynamic monopolized section up to a next depot at which a vehicle stops.

In the vehicle traffic control apparatus according to the 10th aspect, the maximum allocation request range of a dynamic monopolized section is set up to the next depot where a train stops. This can prevent the driver from passing through a station without stopping.

According to the 11th aspect of the present invention, in the vehicle traffic control apparatus according to the first or second aspect, the dynamic monopolized section allocation request unit always sets a predetermined distance as an allocation request range of a dynamic monopolized section.

In the vehicle traffic control apparatus according to the 11th aspect, since the range in which a dynamic monopolized section is requested is constant, the apparatus can be simplified.

According to the 12th aspect of the present invention, in the vehicle traffic control apparatus according to the first or second aspect, the dynamic monopolized section allocation request unit always sets a distance that the corresponding vehicle runs in a predetermined period of time as an allocation request range of a dynamic monopolized section.

In the vehicle traffic control apparatus according to the 12th aspect, since an allocation request range of a dynamic monopolized section is always set to be a distance that a train runs in a predetermined period of time, flexible vehicle running changes can be made on a high density running railroad.

According to the 13th aspect of the present invention, the vehicle traffic control apparatus according to the first or second aspect further comprises a level railroad crossing control device which is set on a vehicle and controls at least one of a barrier and level crossing signal at a railroad crossing which level-crosses the track on the basis of the location and running direction of each vehicle which is detected by the vehicle location detection unit.

In the vehicle traffic control apparatus according to the 13th aspect, the barrier and level crossing signal at each railroad crossing that level-crosses a track are controlled to prevent collisions between trains, people, and the like which pass through the railroad crossing, thus ensuring safety on the track having the crossing.

According to the 14th aspect of the present invention, in the vehicle traffic control apparatus according to the second aspect, the vehicle location detection unit detects, on a vehicle, a location of the vehicle within a track, and further comprises a ground/vehicle transfer unit which transfers and inputs the location of the vehicle, the location being detected by the vehicle location detection unit, from the vehicle to the track/branch device monopolized state control unit.

In the vehicle traffic control apparatus according to the 14th aspect, since the location of a vehicle is detected on the vehicle, the arrangement of the apparatus can be simplified.

According to the 15th aspect of the present invention, the vehicle traffic control apparatus according to the 14th aspect further comprises a ground/vehicle transfer unit which generates a dynamic monopolized section allocation request and dynamic monopolized section deallocation request on the vehicle, the transfer unit transferring and inputting, from the vehicle to the dynamic monopolized section allocation unit, the dynamic monopolized section allocation request from the dynamic monopolized section allocation request unit and the dynamic monopolized section deallocation request from the dynamic monopolized section deallocation request unit on the basis of the location of each vehicle which is detected by the vehicle location detection unit.

In the vehicle traffic control apparatus according to the 15h aspect, since dynamic monopolized section allocation and deallocation requests are made on the basis of the location of each train which is detected on the train, autonomous decentralization type running control on trains can be performed by the train themselves.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 8 is a view showing a control method in a track monopolized state control unit;

FIGS. 10A and 10B are views showing a control method in a track/branch device monopolized state control unit in the second embodiment;

DETAILED DESCRIPTION OF THE INVENTION

The basic concept of a vehicle running mechanism according to the present invention will be described first.

The present invention relates to a system (for example, an ATC (Automatic Train Control) system in the current railroads) for safety running of vehicles, i.e., protecting vehicles from face-to-face collision between vehicles, bumping, derailment, turnover, and the like.

Conventionally, for example, in railroads, a fixed block system in which a block section is fixed is used to secure safety.

In contrast to this, the present invention proposes a method of realizing a moving block system.

For safety running, each vehicle is given a range (monopolized range) in which the vehicle can keep running or stopping. The vehicle, to which this monopolized range is given, can freely run in the range (considering bi-directional running), whereas other vehicles cannot enter the range (exclusive). This running range should sequentially change while the vehicle runs, and hence is referred to as a "dynamic monopolized section).

Each vehicle (or each running control function for controlling vehicle running) therefore always demands allocation of a dynamic monopolized section to itself in a desired running direction (requiring a route and destination), and must cancel the allocation after the monopolized section becomes unnecessary.

On a track having a branch, the branch device must perform a changeover in the joining direction in accordance with the running of a vehicle.

If a branch device is present in the dynamic monopolized section allocated to each vehicle, a track is monopolized first, and then the branch device performs a changeover in a desired running direction. To prevent a vehicle from turning over, the running right must be given to the vehicle to allow it to run after a track is fixed.

An increase in the running density of vehicles and a reduction in cost have currently presented a technical challenge. The present invention aims to attain increases in the speed and running density of railroads in and between urban areas, realize a flexible driving system for facilitating changes in driving patterns in abnormal states, attain a reduction in cost by reducing initial investment for equipment in local railroads and reducing maintenance cost, and achieve reductions in the equipment cost and operation cost of a new traffic system such as a combination of railroads and automobiles.

The embodiments of the present invention based on the above concept will be described in detail below with reference to the views of the accompanying drawing.

(First Embodiment)

Figure 7A:
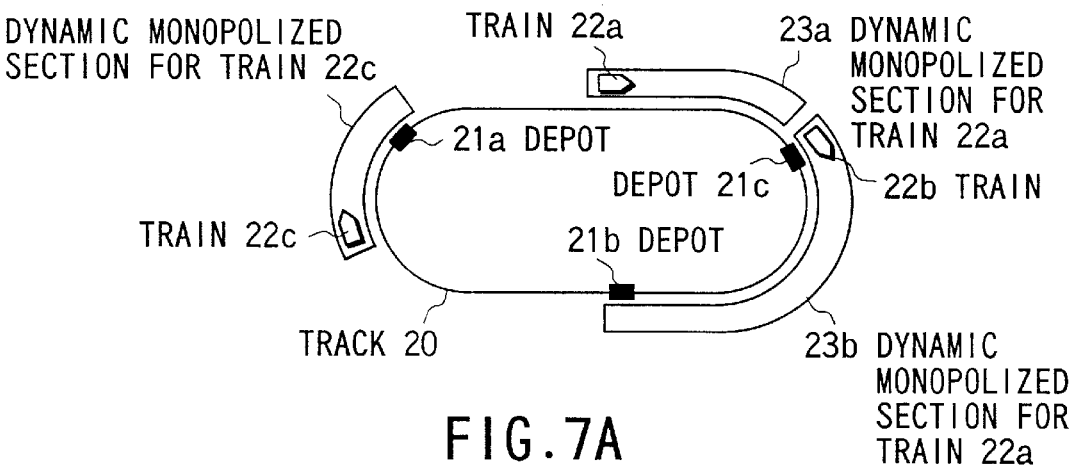
FIGS. 7A to 7E are views each showing a vehicle running railroad.
Figure 7B:
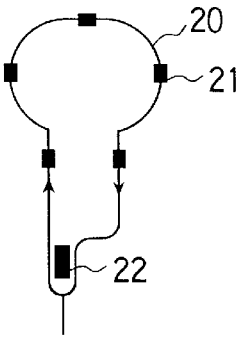
Figure 7C:
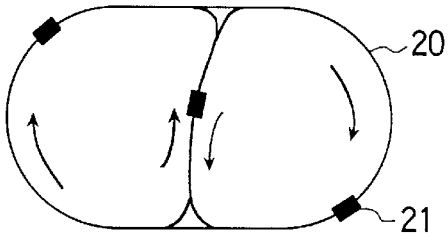

FIGS. 7A to 7C are views each showing a normal vehicle running rail to which the present invention is applied.

Referring to FIGS. 7A to 7C, trains 22*a*, 22*b*, and 22*c* as vehicles run on a track 20.

There are depots 21*a*, 21*b*, and 21*c* on the track 20. In this embodiment, the present invention is applied to one-track/one-direction running and bi-directional running.

Figure 1:
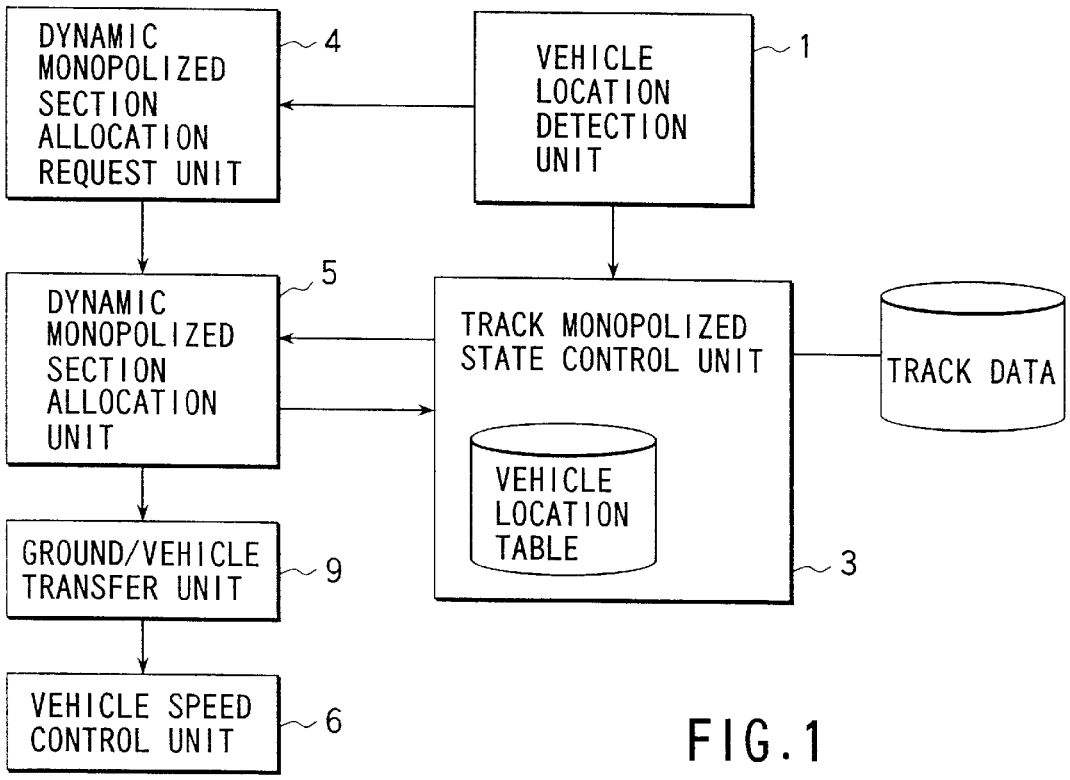
FIG. 1 is a block diagram showing a vehicle traffic control apparatus according to the first embodiment of the present invention.

FIG. 1 is a block diagram showing an example of the arrangement of a vehicle traffic control apparatus according to the first embodiment. The vehicle traffic control apparatus of this embodiment comprises a vehicle location detection unit 1, track monopolized state control unit 3, dynamic monopolized section allocation request unit 4, dynamic monopolized section allocation unit 5, ground/vehicle transfer unit 9, and vehicle speed control unit 6.

The vehicle location detection unit 1 detects the locations of the trains 22*a*, 22*b*, and 22*c* within the track. The track monopolized state control unit 3 stores and manages the locations of all the trains such as the trains 22*a*, 22*b*, and 22*c*, detected by the vehicle location detection unit 1, in the form of a table. The track monopolized state control unit 3 also stores and manages the dynamic monopolized sections allocated to the respective trains 22*a*, 22*b*, and 22*c* by the dynamic monopolized section allocation unit 5, i.e., the monopolized state of the track, in the form of a table.

The dynamic monopolized section allocation request unit 4 determines dynamic monopolized sections as running ranges in which the respective trains 22*a*, 22*b*, and 22*c* can freely run in any directions, e.g., the inbound and outbound directions, on the basis of the locations of the trains 22*a*, 22*b*, and 22*c* which are detected by the vehicle location detection unit 1, and generates corresponding allocation requests.

The dynamic monopolized section allocation unit 5 inquires of the track monopolized state control unit 3 as to the allocation of the dynamic monopolized sections to the trains 22*a*, 22*b*, and 22*c*, which are requested by the dynamic monopolized section allocation request unit 4, and performs collating operation. The dynamic monopolized section allocation unit 5 then actually allocates the dynamic monopolized sections on the basis of this collation result, and stores the allocation result in the track monopolized state control unit 3 and outputs it.

The ground/vehicle transfer unit 9 sends the dynamic monopolized sections allocated by the dynamic monopolized section allocation unit 5 to the trains 22*a*, 22*b*, and 22*c*.

The vehicle speed control unit 6 performs speed control on the trains 22*a*, 22*b*, and 22*c* in accordance with the allocated dynamic monopolized sections sent by the ground/vehicle transfer unit 9.

In other words, in the above vehicle traffic control apparatus, the vehicle speed control unit 6 detects the positions of the trains 22*a*, 22*b*, and 22*c* within the track every constant time (for example, one second). The allocation request unit 4 determines dynamic monopolized sections as running ranges in which the respective trains 22*a*, 22*b*, and 22*c* can freely run in any directions, e.g., the inbound and outbound directions every event such as running of the train or stop thereof, on the basis of the locations of the trains 22*a*, 22*b*, and 22*c* detected by the vehicle speed control unit 6, and requests its allocation. The allocation unit 5 updates the allocation of the dynamic monopolized sections in accordance with the allocation request.

Figure 2:
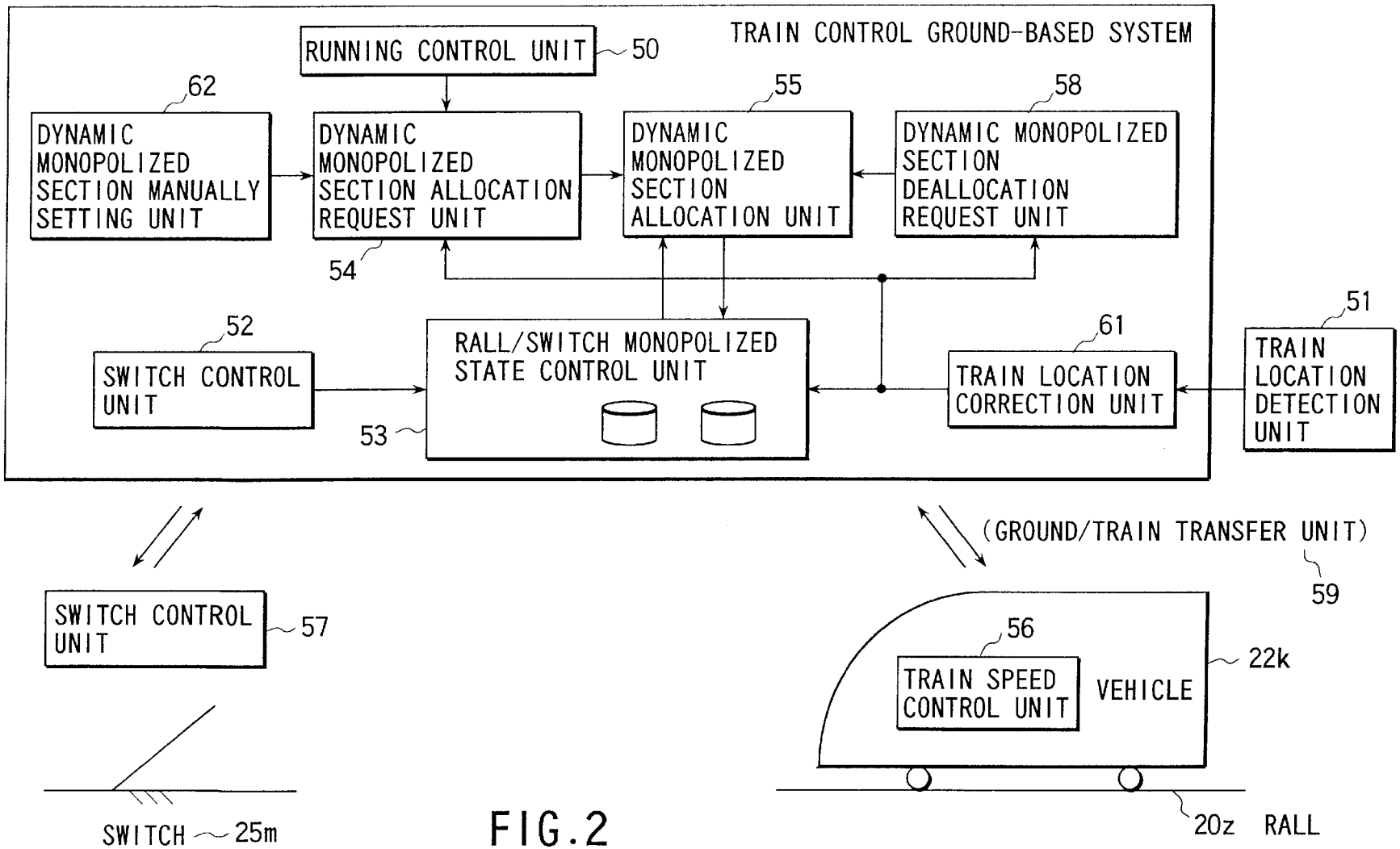
FIG. 2 is a block diagram showing the overall arrangement of a system incorporating the vehicle traffic control apparatus according to the present invention.

FIG. 2 is a block diagram showing a system incorporating this vehicle traffic control apparatus. Note that the arrangement shown in FIG. 2 corresponds to the second, third, fourth, seventh, eighth, 14th, and 15th embodiments as well as this embodiment. Since FIG. 2 shows the overall arrangement of the present invention, this embodiment will be described with reference to FIG. 2.

In this embodiment, the present invention is applied to a railroad system.

Referring to FIG. 2, a train location detection unit 51 detects the locations of all trains in a ground-based center function by using an oscillator, GPS (location measurement system using a satellite), and the like. The train location detection unit 51 corresponds to the vehicle location detection unit 1 on FIG. 1. A rail/switch monopolized state control unit 53 corresponds to the track monopolized state control unit 3 in FIG. 1.

A dynamic monopolized section allocation request unit 54 corresponds to the dynamic monopolized section allocation request unit 4 in FIG. 1. A dynamic monopolized section allocation unit 55 corresponds to the dynamic monopolized section allocation unit 5 in FIG. 1. A train speed control unit 56 corresponds to the vehicle speed control unit 6 in FIG. 1. A ground/train transfer unit 59 corresponds to the ground/vehicle transfer unit 9 in FIG. 1.

The rail/switch monopolized state control unit 53, dynamic monopolized section allocation request unit 54, and dynamic monopolized section allocation unit 55 are the functions of a train control ground system.

The operation of the vehicle traffic control apparatus having the above arrangement according to this embodiment will be described next.

Referring to FIG. 1, the vehicle location detection unit 1 detects the locations of the trains 22*a*, 22*b*, and 22*c* within the track.

The track monopolized state control unit 3 stores the locations of all trains such as the trains 22*a*, 22*b*, and 22*c*, which are output from the vehicle location detection unit 1, in the form of a table. The dynamic monopolized section allocation unit 5 stores the dynamic monopolized sections allocated to the trains 22*a*, 22*b*, and 22*c* in the form of a table.

The dynamic monopolized section allocation request unit 4 requests the allocation of dynamic monopolized sections, which are running ranges in which the trains 22*a*, 22*b*, and 22*c* can freely run in any directions, e.g., the inbound and outbound directions, on the basis of the locations of the trains 22*a*, 22*b*, and 22*c* which are output by the vehicle location detection unit 1. These requested dynamic monopolized sections influence the running density of trains. The track monopolized state control unit 3 manages the dynamic monopolized sections allocated to the trains 22*a*, 22*b*, and 22*c* in the form of a table like the one shown in FIG. 8.

In this embodiment, a railroad system is assumed to be a single-track system, and the section from a siding location including a station to another siding location is regarded as the unit of request. If there is a siding location between stations A and B, a train that departs from the station A to the station B requests an exclusive right to run to the siding location. A train that departs from the station B to the station A also requests an exclusive right to run to the siding location. With this operation, the trains can pass each other on the siding location.

The dynamic monopolized section allocation unit 5 inquires of the track monopolized state control unit 3 as to the allocation of the dynamic monopolized sections to the trains 22*a*, 22*b*, and 22*c* requested by the dynamic monopolized section allocation request unit 4, and performs collating operation. The actual allocation of the dynamic monopolized sections is executed on the basis of this collation result. This allocation result is stored in the track monopolized state control unit 3 and output.

The dynamic monopolized section allocation unit 5 allocates the dynamic monopolized sections requested by the dynamic monopolized section allocation request unit 4 to the trains 22*a*, 22*b*, and 22*c* while collating the sections with the contents stored in the track monopolized state control unit 3.

More specifically, the request ranges of the dynamic monopolized sections are compared with the sections that have already been monopolized by the above trains or other trains. An exclusive right to a section, of the request ranges that are not monopolized by other trains, which follows the section that has already been monopolized by each requesting train is given to the requesting train.

In the ground/vehicle transfer unit 9, for example, a spatial wave radio device sends the dynamic monopolized sections allocated by the dynamic monopolized section allocation unit 5 to the trains 22*a*, 22*b*, and 22*c* by using an LCX cable or the like.

The vehicle speed control unit 6 performs speed control on the trains 22*a*, 22*b*, and 22*c* so as to make them stop before the dynamic monopolized section boundaries in accordance with the allocated dynamic monopolized sections sent through the ground/vehicle transfer unit 9.

The operation of the vehicle traffic control apparatus according to this embodiment will be described in detail next with reference to FIGS. 3, 4A to 4F, and 6.

Figure 3:
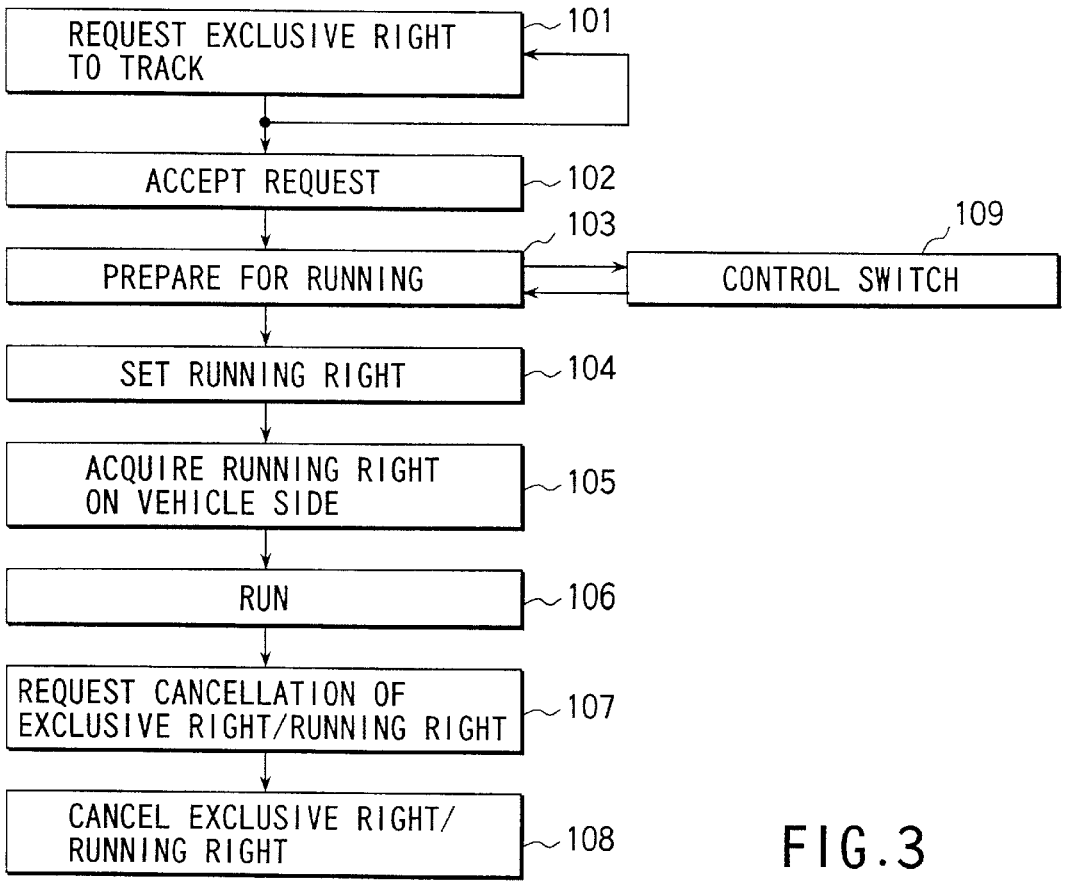
FIG. 3 is a flow chart for explaining the flow of processing associated with train running operation performed by the vehicle traffic control apparatus according to the present invention.

FIG. 3 is a flow chart showing the flow of processing associated with running of trains.

Referring to FIG. 3, when a train starts running, the train requests an exclusive right to a track first (step 101).

The train control ground system checks whether the rail is monopolized by another train. If the rail is not monopolized, the system accepts the request (step 102).

If the rail is monopolized by another train, the train control ground system makes this train monopolize the section to the section monopolized by another train (this operation will be referred to as partial acceptance). This train keeps generating this request until all the requested section is accepted.

If this request is accepted, the exclusive right to the track in this section is given to this train, and the section becomes the dynamic monopolized section for the train. In the section to which the train is given the exclusive right, preparations for running are made in accordance with the running route of the train (step 103).

When the preparations for running are completed, the train control ground system set a running right (step 104), and sends the corresponding information to the train. Upon reception of the running right (step 105), the train runs for the first time (step 106).

After the train runs, a request is made to cancel the exclusive right and running right to the section through which the train has already run so as to allow another train to run (step 107), and the exclusive right and running right are canceled (step 108).

FIGS. 4A to 4F are conceptual views each showing a vehicle (train) running mechanism, and more specifically, the process of requesting an exclusive right and accepting it.

Figure 4A:
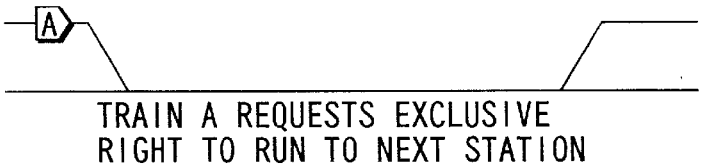
FIGS. 4A to 4F are views showing the concept of a vehicle (train) running mechanism.
Figure 4B:
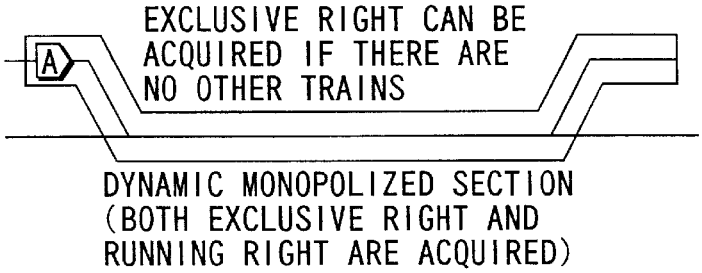
Figure 4C:
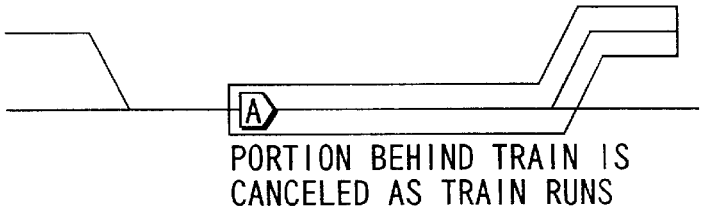
Figure 4D:
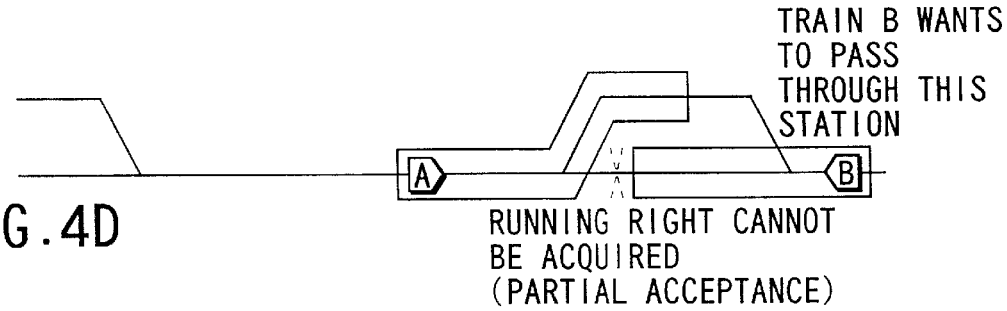
Figure 4E:
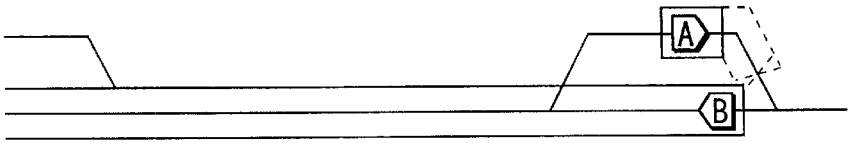
Figure 4F:
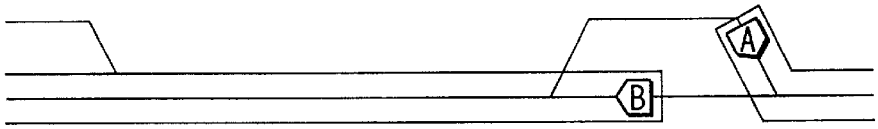

Referring to FIG. 4A, a train A requests an exclusive right to run to the next station. Referring to FIG. 4B, if no other trains have acquired the exclusive right, a dynamic monopolized section is allocated to the train A. Referring to FIG. 4C, as the train runs, the dynamic monopolized section behind the train is automatically deallocated. Referring to FIG. 4D, assume that a train B requests an exclusive right while contending against the train A. Since the train B contends (competes) against the train A for the track on which the train B wants to run, the train B acquires an exclusive right within a range in which the train B does not contend with the train A. Referring to FIG. 4E, the train B monopolizes the section to the next station, and hence the train A cannot travel to a merging portion because of the train B even though the train A departs the station. Referring to FIG. 4F, as the train B advances, the train A can advance.

Figure 6:
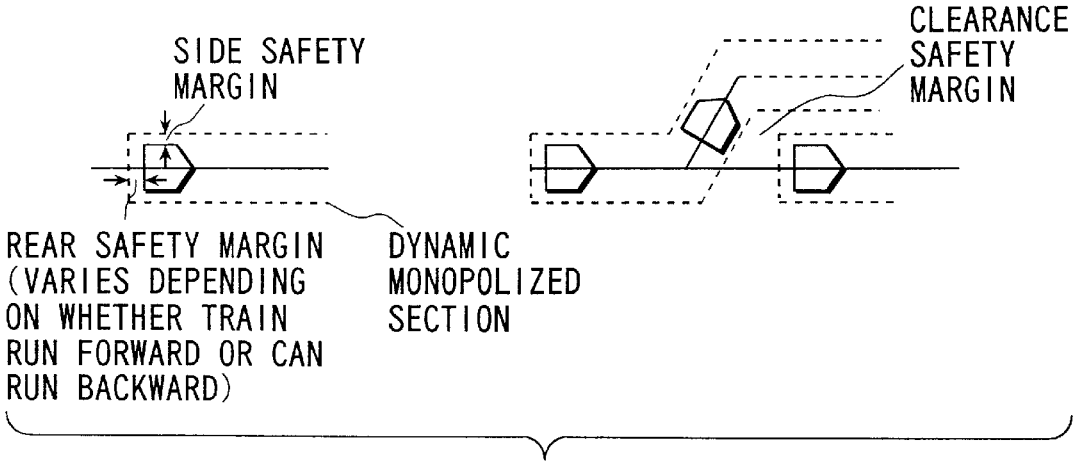
FIG. 6 is a view showing the concept of a method of setting the ranges of dynamic monopolized sections, which is the main point of the present invention.

FIG. 6 is a conceptual view showing an example of how a dynamic monopolized section is allocated. As shown in FIG. 6, a dynamic monopolized section is set to form an environment in which a train can keep running or stopping with safety. The dynamic monopolized section allocation request unit 4 forms a dynamic monopolized section ahead of a train in accordance with the running range of the train. A margin is set on each side of the dynamic monopolized section to prevent the train from contacting another train and the like owing to a cant and the like. In addition, the size of the dynamic monopolized section in the height direction is set in consideration of the sum of the height of the train and a margin. Furthermore, if the train runs only forward, a margin corresponding to an error in location detection (e.g., about 20 cm) is set behind the train. If the train may run backward or bi-directionally, a distance corresponding to the running speed is to be considered. On a track having a branch, in particular, a clearance should be considered in allocating a dynamic monopolized section at the branch or merging portion.

This embodiment will be described with reference to FIG. 1. The vehicle location detection unit 1 detects the locations of vehicles within a track, and inputs the locations to the track monopolized state control unit 3 that controls the dynamic monopolized sections allocated to the trains 22*a*, 22*b*, and 22*c* by the dynamic monopolized section allocation unit 5. At this time, as the locations of the trains 22*a*, 22*b*, and 22*c* change, portions of the dynamic monopolized sections which are located behind the respective trains are automatically deallocated.

As described above, since the vehicle traffic control apparatus according to this embodiment uniquely allocates running sections to the trains 22*a*, 22*b*, and 22*c*, collisions such as bumps between trains can be prevented. This allows the respective trains to run with safety.

In addition, as the trains 22*a*, 22*b*, and 22*c* run, exclusive rights to portions of the dynamic monopolized sections which are located behind the respective trains are automatically deallocated to sequentially update the sections monopolized by the trains 22*a*, 22*b*, and 22*c*. This makes it possible to perform flexible running control on the respective trains.

Furthermore, the use of the satellite for the detection of the locations of trains facilitates maintenance for a railroad system having long rails, e.g., a long-distance railroad system in a continental region, in particular.

The vehicle location detection unit 1 for detecting the locations of the trains 22*a*, 22*b*, and 22*c* is not limited to the form in the first embodiment and may take an access check scheme using a track circuit, transponder, and limit switch.

The range in which each train requests the allocation of the dynamic monopolized section described is not limited to the form in the first embodiment. For example, each of the trains 22*a*, 22*b*, and 22*c* can request the allocation of a dynamic monopolized section in units of sections between stations.

In this case, each train acquires an exclusive right to a section within the range in which other trains do not monopolize the section. If, however, a given train monopolizes a long section too early, no other trains can run on the section until the given train runs.

(Second Embodiment)

Figure 7D:
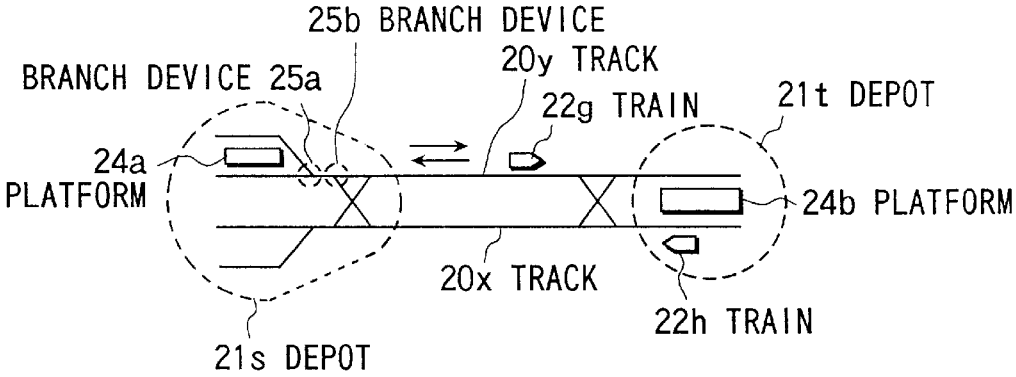
Figure 7E:
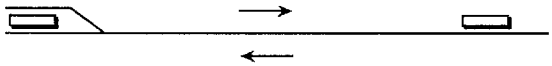

FIGS. 7D and 7E show another vehicle running rail having a branch to which the present invention is applied.

Referring to FIGS. 7D and 7E, trains 22*g* and 22*h* as vehicles run on tracks 20*x* and 20*y*, respectively. There are depots 21*s* and 21*t* on the tracks 20*x* and 20*y*. Branch devices 25*a* and 25*b* are set at a branch point of the track 20*x*. In this case, running directions are predetermined on the respective tracks of a double-track line to perform bi-directional running. Reference numerals 24*a* and 24*b* denote platforms.

Figure 9:
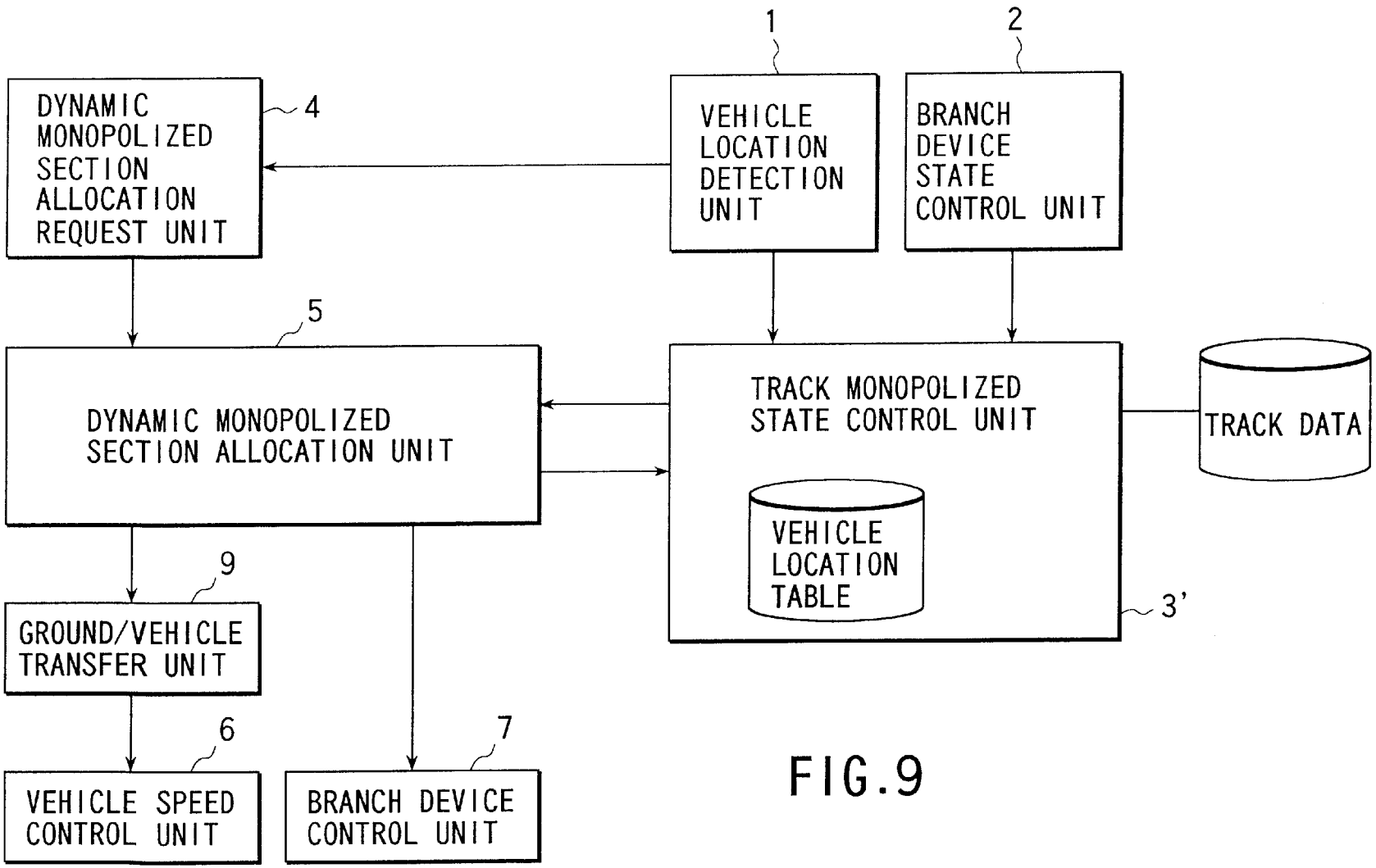
FIG. 9 is a block diagram showing a vehicle traffic control apparatus according to the second embodiment of the present invention.

FIG. 9 is a block diagram showing an example of the arrangement of a vehicle traffic control apparatus according to the second embodiment. The same reference numerals as in FIG. 1 denote the same parts in FIG. 9, and a description thereof will be omitted. only different portions will be described below.

As shown in FIG. 9, the vehicle traffic control apparatus according to the second embodiment includes a branch device state control unit 2 and branch device control unit 7 in addition to the arrangement shown in FIG. 1, and uses a track/branch device monopolized state control unit 3' in place of the track monopolized state control unit 3. In addition, a dynamic monopolized section allocation request unit 4 and dynamic monopolized section allocation unit 5 in the second embodiment have functions different from those in the first embodiment.

The branch device state control unit 2 controls the joining directions of the branch devices installed at the branch point on the track and the states of the branch devices, e.g., direction changing states and fixed states.

The track/branch device monopolized state control unit 3' stores and controls the locations of all trains such as trains 22*a*, 22*b*, and 22*c*, which are detected by a vehicle location detection unit 1, and the states of the branch devices, which are controlled by the branch device state control unit 2, in the form of a table. The track/branch device monopolized state control unit 3' also stores and controls the dynamic monopolized sections allocated to the trains 22*a*, 22*b*, and 22*c* by the dynamic monopolized section allocation unit 5 and the monopolized states of the branch devices in the form of a table.

The dynamic monopolized section allocation request unit 4 determines dynamic monopolized sections as running ranges in which the trains 22*a*, 22*b*, and 22*c* can freely run in any directions, e.g., the inbound and outbound directions, on the basis of the locations of the trains 22*a*, 22*b*, and 22*c*, which are detected by the vehicle location detection unit 1, and the states of the branch devices, which are controlled by the branch device state control unit 2, and branch devices. The dynamic monopolized section allocation request unit 4 then requests the allocation of the determined dynamic monopolized sections and branch devices.

The dynamic monopolized section allocation unit 5 inquires of the dynamic monopolized section allocation request unit 4 as to the allocation of the dynamic monopolized sections and branch devices to the trains 22*a*, 22*b*, and 22*c* by the dynamic monopolized section allocation request unit 4, and performs collating operation. The dynamic monopolized section allocation unit 5 then actually allocate the dynamic monopolized sections and branch devices on the basis of the collation result, and stores the allocation result in the track/branch device monopolized state control unit 3' and outputs it.

The branch device control unit 7 changes and fixes the joining directions of the branch devices allocated by the dynamic monopolized section allocation unit 5.

FIG. 2 is a block diagram showing an example of the overall arrangement of a system incorporating this vehicle traffic control apparatus. The same reference numerals as in the first embodiment denote the same parts in the second embodiment, and a description thereof will be omitted. Only different portions will be described below.

Referring to FIG. 2, a rail/switch monopolized state control unit 53 corresponds to the branch device state control unit 2 and track monopolized state control unit 3 in FIG. 9.

A switch control unit 57 corresponds to the branch device control unit 7 in FIG. 9.

A switch control unit 52 controls the joining directions of the branch devices.

The operation of the vehicle traffic control apparatus having the above arrangement according to this embodiment will be described.

A description of the operations of the same components as those in FIG. 1 will be omitted, and only different portions will be described below.

Referring to FIG. 9, the branch device state control unit 2 stores the monopolized states of the branch devices installed at the branch point on the track in the form of a table. That is, the branch device state control unit 2 controls the joining directions of the branch devices and the states of the branch devices, e.g., direction changing states and fixed states. The track/branch device monopolized state control unit 3' stores and controls the locations of all trains such as trains 22*a*, 22*b*, and 22*c*, which are output from a vehicle location detection unit 1, and the states of the branch devices, which are output from the branch device state control unit 2, in the form of a table. The track/branch device monopolized state control unit 3' also stores and controls the dynamic monopolized sections allocated to the trains 22*a*, 22*b*, and 22*c* by the dynamic monopolized section allocation unit 5 and the monopolized states of the branch devices in the form of a table. That is, the track/branch device monopolized state control unit 3' controls the monopolized states of the branch devices in the form of a table as shown in FIGS. 10A and 10B as well as the dynamic monopolized sections allocated to the trains 22*a*, 22*b*, and 22*c* in the form of a table as shown in FIG. 8.

The dynamic monopolized section allocation request unit 4 requests allocation of dynamic monopolized sections as running ranges in which the trains 22*a*, 22*b*, and 22*c* can freely run in any directions, e.g., the inbound and outbound directions, and allocation of branch devices on the basis of the locations of the trains 22*a*, 22*b*, and 22*c*, which are output from the vehicle location detection unit 1, and the states of the branch devices, which are output from the branch device state control unit 2.

The dynamic monopolized section allocation unit 5 inquires of the dynamic monopolized section allocation request unit 4 as to the allocation of the dynamic monopolized sections and branch devices to the trains 22*a*, 22*b*, and 22*c* by the dynamic monopolized section allocation request unit 4, and performs collating operation. The dynamic monopolized section allocation unit 5 then actually allocates the dynamic monopolized sections and branch devices on the basis of the collation result, and stores the allocation result in the track/branch device monopolized state control unit 3' and outputs it.

The branch device control unit 7 changes and fixes the joining directions of the branch devices allocated by the dynamic monopolized section allocation unit 5.

The operation of the vehicle traffic control apparatus according to the second embodiment will be described in detail next with reference to FIGS. 3 and 5.

FIG. 3 is a flow chart showing the flow of processing associated with running of trains.

Referring to FIG. 3, when a train starts running, the train requests an exclusive right to a track first (step 101). The train control ground system checks whether the rail and switch are monopolized by another train. If the rail and switch are not monopolized, the system accepts the request (step 102). If the rail is monopolized by another train, the train control ground system makes this train monopolize the section to the section monopolized by another train (this operation will be referred to as partial acceptance). This train keeps generating this request until all the requested section is accepted. If this request is accepted, the exclusive right to the track in this section is given to this train, and the section becomes the dynamic monopolized section for the train. In the section to which the train is given the exclusive right, preparations for running are made in accordance with the running route of the train (step 103). In this case, on the track having a branch, the switch is switched (step 109).

When the preparations for running are completed, the train control ground system set a running right (step 104), and sends the corresponding information to the train. Upon reception of the running right (step 105), the train runs for the first time (step 106).

After the train runs, a request is made to cancel the exclusive right and running right to the section through which the train has already run so as to allow another train to run (step 107), and the exclusive right and running right are canceled (step 108).

Figure 5A:
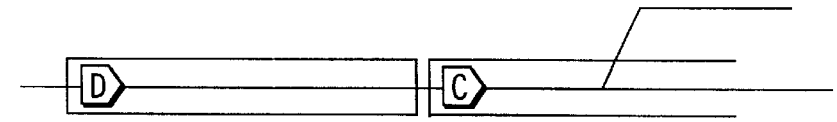
FIGS. 5A to 5C are views showing the concept of a vehicle (train) running mechanism.
Figure 5B:
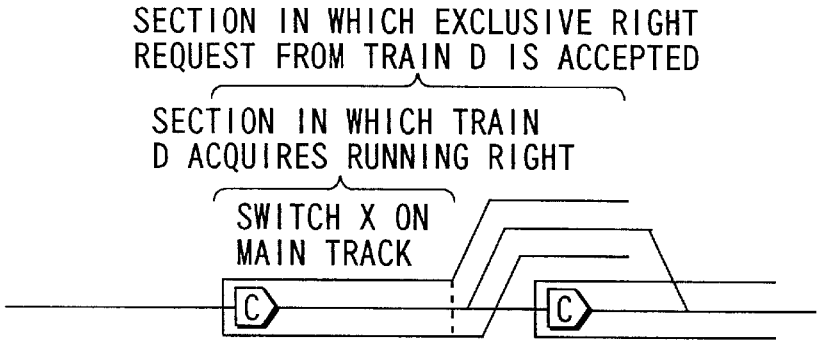
Figure 5C:
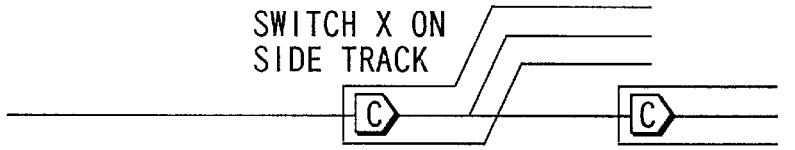

FIGS. 5A to 5C are conceptual views showing a vehicle (train) running mechanism, and more specifically, an example of how the acceptance range of an exclusive right is expanded, preparations for running are made, and a running right is set.

Assume that a train C runs on a main track while a train D runs to a siding, in FIG. 5A. The train D is given an exclusive right to a portion behind the train C, and is running. Referring to FIG. 5B, as the train C advances, the monopolized state of a switch X by the train C is canceled, and the train D monopolizes the track entering the siding. The switch control unit then starts switching the switch to prepare for running. Referring to FIG. 5C, after the switch is completely switched and fixed, a running right to the remaining section of the dynamic monopolized section of the train D is also set.

As described above, in addition to the same effects as those of the first embodiment, the vehicle traffic control apparatus of the second embodiment has the following effect. Since an exclusive right to a branch device can be easily allocated, even a track having a branch is uniquely allocated to a vehicle when the direction of the branch device is to be changed and the vehicle is to pass through it, and the vehicle is made to run after the direction of the branch device is changed and fixed. This prevents the vehicle from colliding with another vehicle face to face or side to side, derailing, and turning over, and can ensure safety running.

(Third Embodiment)

Figure 11:
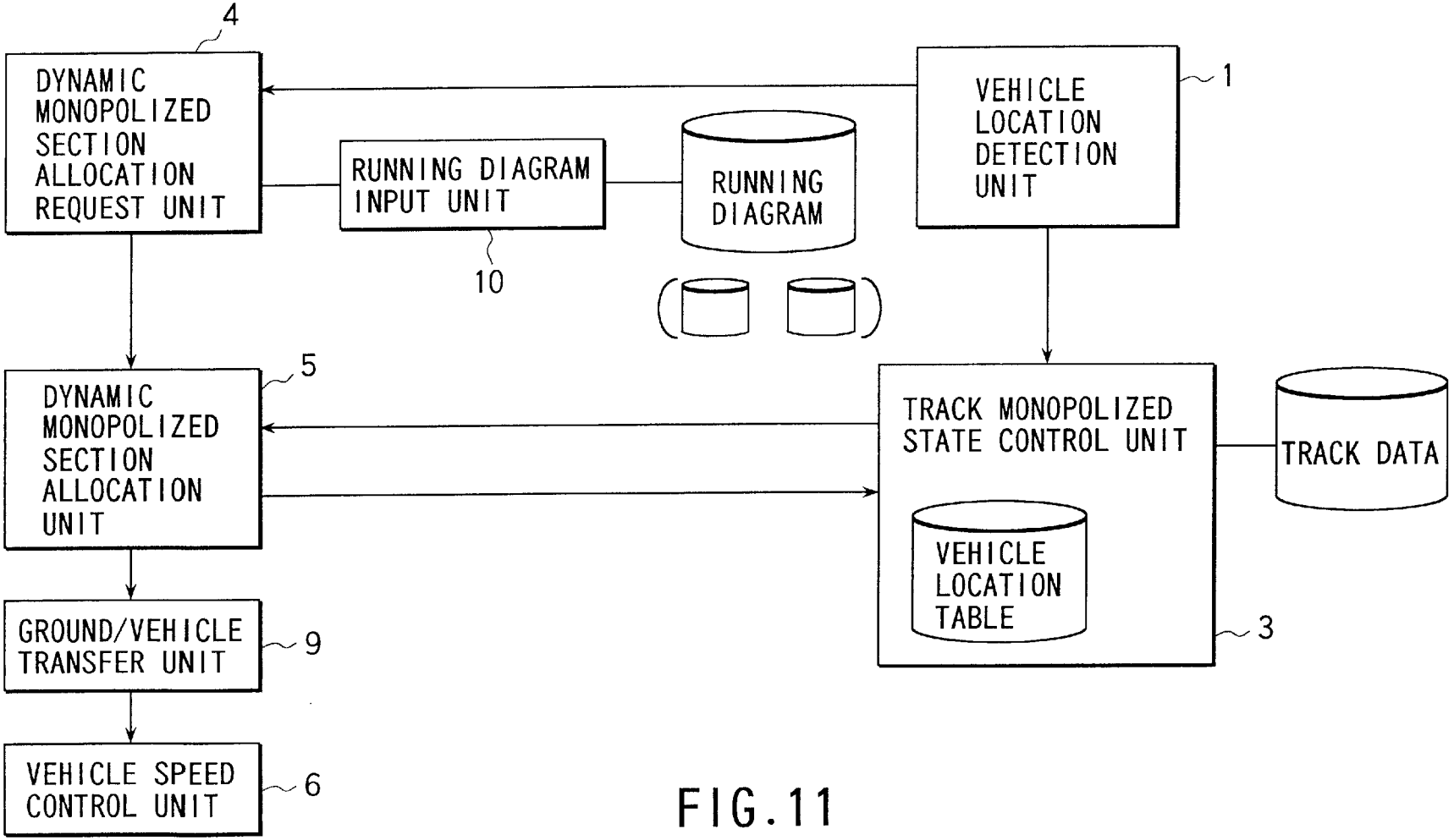
FIG. 11 is a block diagram showing a vehicle traffic control apparatus according to the third embodiment of the present invention.

FIG. 11 is a block diagram showing an example of the arrangement of a vehicle traffic control apparatus according to the third embodiment. The same reference numerals as in FIG. 1 denote the same parts in FIG. 11, and a description thereof will be omitted. Only different portions will be described below.

As shown in FIG. 11, the vehicle traffic control apparatus according to the third embodiment has a running diagram input unit 10 in addition to the arrangement shown in FIG. 1. The running diagram input unit 10 inputs the running diagram of trains 22*a*, 22*b*, and 22*c* to a dynamic monopolized section allocation request unit 4. The dynamic monopolized section allocation request unit 4 determines allocation request ranges of dynamic monopolized sections by using the vehicle running diagram input from the running diagram input unit 10.

The operation of the vehicle traffic control apparatus having the above arrangement according to this embodiment will be described next.

A description of the operations of the same components as those in FIG. 1 will be omitted, and only different portions will be described below.

Referring to FIG. 11, the dynamic monopolized section allocation request unit 4 determines allocation request ranges of dynamic monopolized section by using the running diagram of the trains 22*a*, 22*b*, and 22*c* which is input through the running diagram input unit 10. To determine allocation request ranges of dynamic monopolized sections is to determine request timings.

Request ranges for the trains 22*a*, 22*b*, and 22*c* are determined in accordance with the running diagram of a track as follows. Consider a suburb line, for example. In a section near an urban area in which the running density is high, short request ranges are set in units of stations, for example. In a section remote from the urban area in which the running density is low, request ranges are set in units of main stations.

As described above, in addition to the same effects as those of the first embodiment, the vehicle traffic control apparatus of this embodiment has the following effect. Since allocation of dynamic monopolized sections is requested with reference to the running diagram of vehicles, not only the running plan of a self-train but also the running plans of other trains can be considered. This makes it possible to simplify the apparatus. In addition, in a normal state or in case of a traffic jam, accident, or the like, efficient vehicle running can be performed by quickly responding to requests for dynamic running diagram changes.

(Fourth Embodiment)

Figure 12:
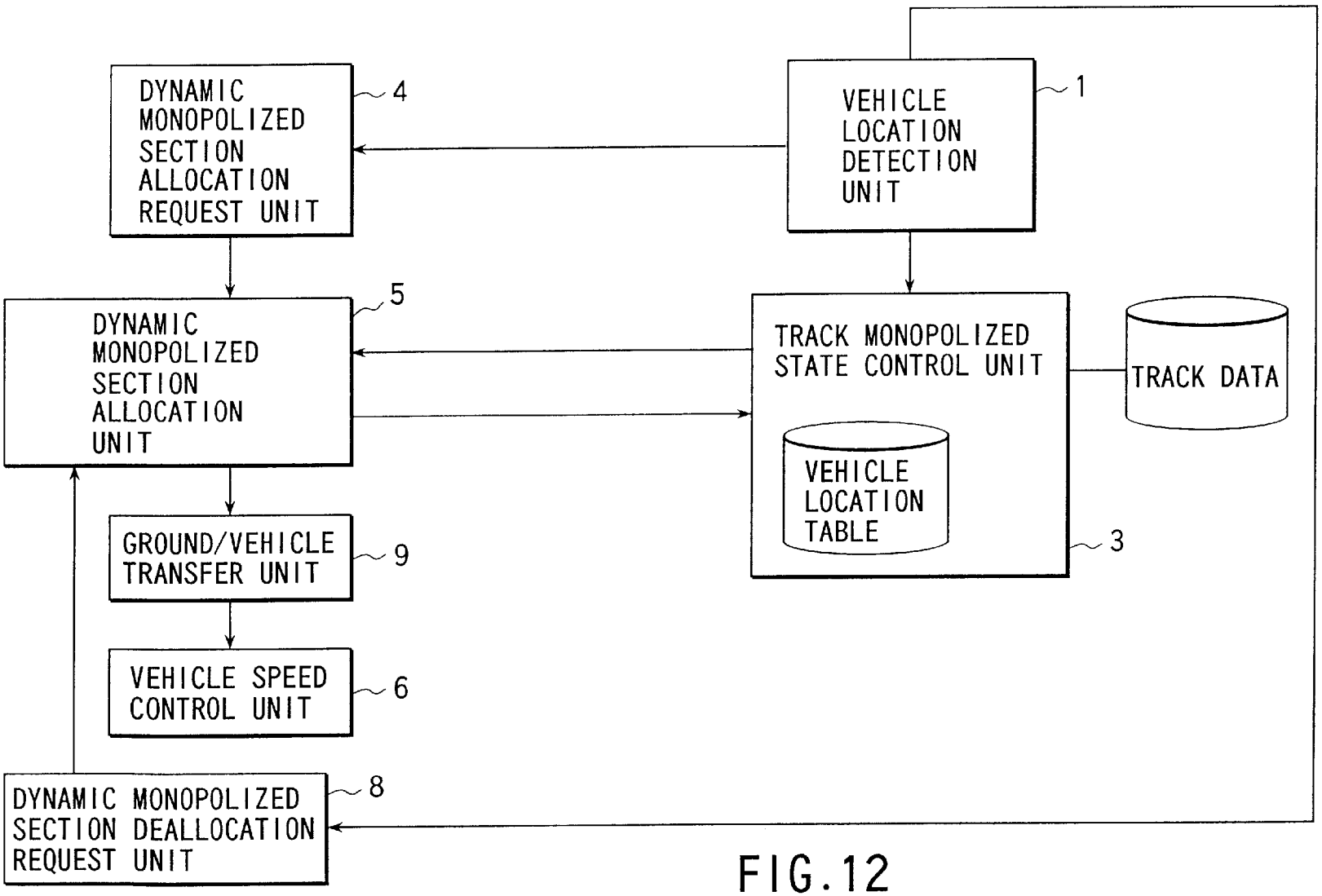
FIG. 12 is a block diagram showing a vehicle traffic control apparatus according to the fourth embodiment of the present invention.

FIG. 12 is a block diagram showing an example of the arrangement of a vehicle traffic control apparatus according to the fourth embodiment. The same reference numerals as in FIG. 1 denote the same parts in FIG. 12, and a description thereof will be omitted. Only different portions will be described below.

As shown in FIG. 12, the vehicle traffic control apparatus according to this embodiment includes a dynamic monopolized section deallocation request unit 8 (corresponding to a dynamic monopolized section deallocation request unit 58 in FIG. 2) in addition to the arrangement shown in FIG. 1.

The dynamic monopolized section deallocation request unit 8 determines the ranges of dynamic monopolized sections behind trains 22*a*, 22*b*, and 22*c* which are to be deallocated as the trains run, together with the deallocation timings, on the basis of the locations of the respective trains which are detected by a vehicle location detection unit 1. In addition, when an initial running plan is to be changed due to an accident or the like, the dynamic monopolized section deallocation request unit 8 requests the dynamic monopolized section allocation unit 5 to deallocate the dynamic monopolized sections.

The operation of the vehicle traffic control apparatus having the above arrangement according to this embodiment will be described next.

A description of the operations of the same components as those in FIG. 1 will be omitted, and only different portions will be described below.

In the first embodiment, exclusive rights to portions of the dynamic monopolized section which are located behind the trains 22*a*, 22*b*, and 22*c* are automatically canceled as the trains run. In contrast to this, the dynamic monopolized section deallocation request unit 8 in FIG. 11 receives the output from the vehicle location detection unit 1 and determines the deallocation ranges of the dynamic monopolized section behind the trains 22*a*, 22*b*, and 22*c* and deallocation timings as the respective trains run.

When a running section is to be changed owing to a delay of a train, accident, or the like, the dynamic monopolized section deallocation request unit 8 requests the deallocation of the dynamic monopolized sections that have been requested and accepted. In this case, if the train takes a normal deceleration notch after a lapse of a transmission time (e.g., 10 sec), the deallocation range of the dynamic monopolized section is set ahead of the train in the running direction while the sum of the distance required to stop the train and an error margin (e.g., 20 m) is left as an exclusive right.

As described above, in addition to the same effects as those of the first embodiment, the vehicle traffic control apparatus of the fourth embodiment has the following effect. Since exclusive rights to dynamic monopolized sections of trains are canceled not only sequentially but also in predetermined cycles after the trains run, the apparatus can be simplified.

In addition, since the allocation of dynamic monopolized sections for running can be canceled when a running plan changes, efficient vehicle running can be realized.

Furthermore, the distance required to stop a train is calculated on the basis of the normal deceleration at which the train can stop in consideration of a transmission delay, thereby considering a margin for safety. This prevents the train from colliding with another train and derailing, and allows a flexible response to a train running request.

(Fifth Embodiment)

In a vehicle traffic control apparatus according to the fifth embodiment, the dynamic monopolized section deallocation request unit 8 in the fourth embodiment shown in FIG. 12 sets the deallocation timing of a dynamic monopolized section as the same timing as the timing of a dynamic monopolized section allocation request.

In the vehicle traffic control apparatus having the above arrangement according to the fifth embodiment, dynamic monopolized section allocation and deallocation requests are generated on a train. In this case, the dynamic monopolized section deallocation request unit 8 sets the deallocation timing of a dynamic monopolized section as the same timing as the timing of a dynamic monopolized section allocation request. This can reduce the load of ground/vehicle transfer and simplify the apparatus.

As described above, in addition to the same effects as those of the fourth embodiment, the vehicle traffic control apparatus according to the fifth embodiment has the following effect. Since dynamic monopolized section allocation and deallocation requests are generated at the same timing, the load of ground/vehicle transfer is reduced, and the apparatus can be simplified.

(Sixth Embodiment)

A vehicle traffic control apparatus of the sixth embodiment has the same arrangement as that of the first embodiment shown in FIG. 1. In this arrangement, the vehicle speed control unit 6 in FIG. 1 has the function of forming a deceleration curve from the end position of a dynamic monopolized section (the end point in the running direction of the vehicle) to the start position in consideration of the performance of the vehicle and linearity of the track, and automatically adjusting the speed of the vehicle to reduce its speed along the deceleration curve.

The operation of the vehicle traffic control apparatus having the above arrangement according to this embodiment will be described next with reference to FIG. 13.

A description of the operations of the same components as those in FIG. 1 will be omitted, and only different portions will be described below.

Figure 13:
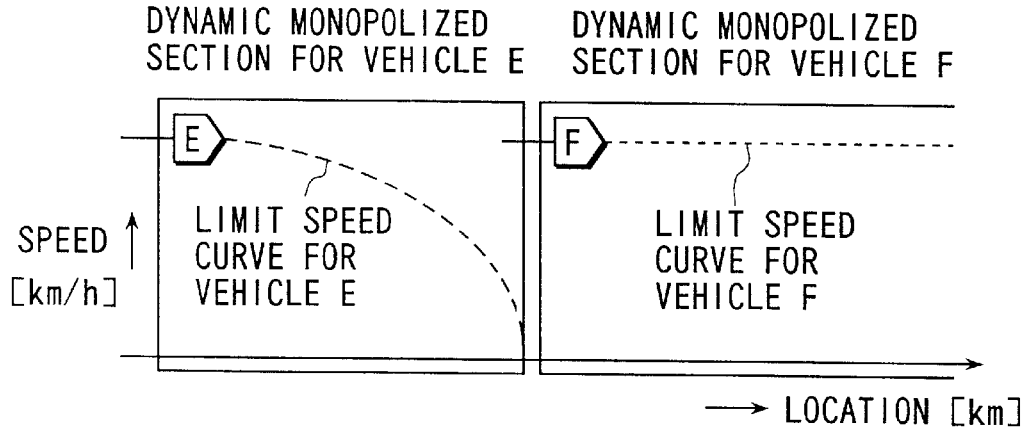
FIG. 13 is a view for explaining the operation of a vehicle traffic control apparatus according to the sixth embodiment of the present invention.

FIG. 13 shows an example of how limit speeds are set for vehicles E and F when they successively run. Assume that the vehicle F runs forward at a predetermined limit speed without any obstacles in the range shown in FIG. 13. The dynamic monopolized section shown in FIG. 13 is set for the vehicle E owing to the preceding vehicle F, and a limit speed is determined for the vehicle E, as shown in FIG. 13, such that the vehicle E does not overrun the monopolized section.

The vehicle speed control unit 6 forms a deceleration curve from the end position of the dynamic monopolized section (the end point in the running direction of the vehicle) to the start position in consideration of the performance of the vehicle and linearity of the track, and automatically adjusts the speed of the vehicle to reduce its speed along the deceleration curve.

The respective vehicles can run with safety without overrunning by forming deceleration curves of the vehicles and controlling their speeds to follow the curves in this manner.

As described above, in addition to the same effects as those of the first embodiment, the vehicle traffic control apparatus according to the sixth embodiment has the following effect. In controlling the speeds of vehicles, deceleration curves are formed, and the speeds of the vehicles are controlled in accordance with the deceleration curves. This makes it possible to stop the vehicles with safety without making them overrun the dynamic monopolized sections.

(Seventh Embodiment)

Figure 14:
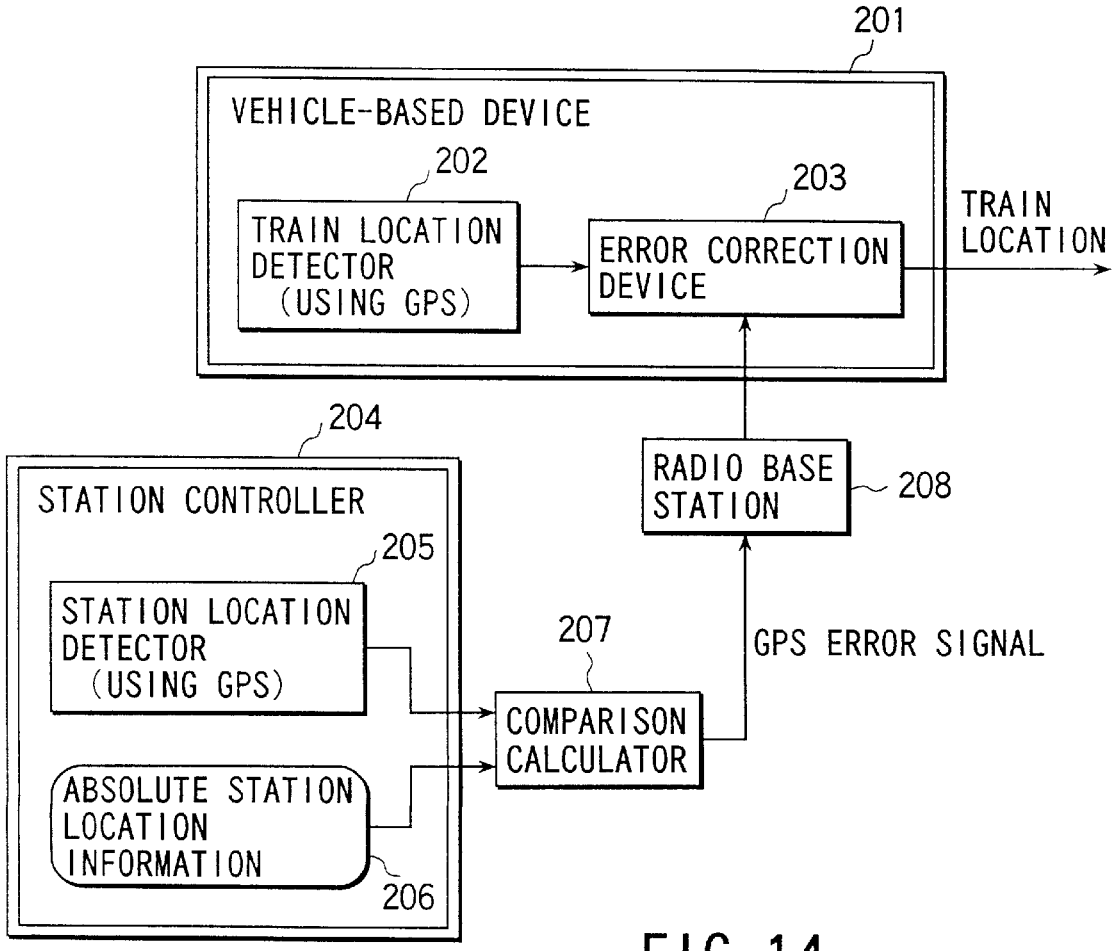
FIG. 14 is a block diagram showing a vehicle traffic control apparatus according to the seventh embodiment of the present invention.

FIG. 14 is a block diagram showing an example of the arrangement of the main part of a vehicle traffic control apparatus according to the seventh embodiment. The same reference numerals as in FIG. 1 denote the same parts in FIG. 14, and a description thereof will be omitted. Only different portions will be described below. The vehicle traffic control apparatus of the seventh embodiment has a vehicle location error correction unit (corresponding to a train location correction unit 61 in FIG. 2) in addition to the arrangement shown in FIG. 1.

The vehicle location error correction unit detects the locations of depots scattered on a track, measures the errors between the detected locations and the actual locations, and corrects the locations of the vehicles which are detected by the vehicle location detection unit 1. According to the seventh embodiment, a station location detector 205 detects the locations of depots scattered on a track through a station location detector 205 using the GPS of a station controller 204, and a comparison calculator 207 measures the errors between the detected locations and actual locations (absolute locations) 206. Each error is sent to an error correction device 203 through a radio base station 208. The error correction device 203 then corrects the location of the vehicle which is detected by a train location detector 202, which corresponds to the vehicle location detection unit 1 using a GPS, thereby obtaining the final train location.

In the vehicle traffic control apparatus having the above arrangement according to the seventh embodiment, the vehicle location error correction unit corrects the detected location of the vehicle, i.e., the output from the vehicle location detection unit 1, by using the error between the detected location of a fixed object such as a station and the absolute value. In this case, since the station location is compared with the absolute value, error signals can be evenly formed along a track. This improves the vehicle location correction precision.

As described above, in addition to the same effects as those of first embodiment, the vehicle traffic control apparatus according to the seventh embodiment has the following effect. Since an error in the detected vehicle location is corrected by using the location detection error between the detected location of a fixed object and the absolute value, the vehicle location detection precision improves. As a consequence, the margin distance can be decreased, and the running density of vehicles can be increased.

(Eighth Embodiment)

A vehicle traffic control apparatus according to the eighth embodiment has the same arrangement as that of the first embodiment shown in FIG. 1. This apparatus has a dynamic monopolized section manual setting section (corresponding to a dynamic monopolized section manual setting section 62 in FIG. 2) in addition to the arrangement shown in FIG. 1. The dynamic monopolized section manual setting section is used to manually set a section to which the accesses of trains are to be inhibited.

In the vehicle traffic control apparatus having the above arrangement according to this embodiment, the dynamic monopolized section manual setting section is used to manually set a section to which the accesses of trains are to be inhibited. This operation is performed independently of the operation of requesting and acquiring a dynamic monopolized section in accordance with the route and destination of a train as the train runs. With this operation, when a track is monopolized by a given train using a dynamic monopolized section, the accesses of other trains are inhibited. This makes it possible to arbitrarily set a closed railroad section or the like at an arbitrary timing.

As described above, in addition to the same effects as those of the first embodiment, the vehicle traffic control apparatus of this embodiment has the following effect. A given range on a track can be separated from a running system by setting this range as a section to which the accesses of vehicles are inhibited.

(Ninth Embodiment)

A vehicle traffic control apparatus according to the ninth embodiment has the same arrangement as that of the first embodiment shown in FIG. 1. The dynamic monopolized section allocation unit 5 in FIG. 1 allocates a dynamic monopolized section to a given vehicle in consideration of not only the dynamic monopolized sections that have been allocated to other vehicles but also information from a running obstacle detector, railroad crossing control device, and rail closing control device, which are arranged along a railroad, such as an amount-of-rainfall detector, fallen stone detector, obstacle detector.

In the vehicle traffic control apparatus having the above arrangement according to this embodiment, when the dynamic monopolized section allocation unit 5 determines allocation to a given train, the unit receives not only information indicating the dynamic monopolized sections that have already been allocated to other vehicles but also information such as fallen stone information and obstacle information from a running obstacle detector, railroad crossing control device, and rail closing control device, which are arranged along a railroad, such as an amount-of-rainfall detector, fallen stone detector, obstacle detector. The dynamic monopolized section allocation unit 5 then allocates a dynamic monopolized section to the train while avoiding these points (allocating the section before these points).

Since permission/inhibition of the access of each vehicle is determined by allocating a dynamic monopolized section in this manner, the train running control system including these detectors can be implemented in a simple form.

As described above, in addition to the same effects as those of the first embodiment, the vehicle traffic control apparatus according to the ninth embodiment has the following effect. Since permission/inhibition of the access of each vehicle is determined by allocating a dynamic monopolized section in this manner, the train running control system including these detectors can be implemented in a simple form.

(10th Embodiment)

A vehicle traffic control apparatus according to the 10th embodiment has the same arrangement as that of the first embodiment shown in FIG. 1. In this arrangement, the dynamic monopolized section allocation request unit 4 in FIG. 1 sets the maximum allocation request range of a dynamic monopolized section up to the next depot whether the train stops.

In the vehicle traffic control apparatus having the above arrangement according to this embodiment, the dynamic monopolized section allocation request unit 4 sets the maximum allocation request range of a dynamic monopolized section up to the next depot whether the train stops, and requests allocation of a dynamic monopolized section to the next station after the train stops the depot. This can prevent the driver from passing through a station without stopping.

As described above, in addition to the same effects as those of the first embodiment, the vehicle traffic control apparatus according to this embodiment has the following effect. The maximum allocation request range of a dynamic monopolized section is set up to the next depot where a train stops. This can prevent the driver from passing through a station without stopping.

(11th Embodiment)

A vehicle traffic control apparatus according to the 11th embodiment has the same arrangement as that of the first embodiment shown in FIG. 1. In this arrangement, the dynamic monopolized section allocation request unit 4 in FIG. 1 always sets a predetermined distance as an allocation request range of a dynamic monopolized section.

In the vehicle traffic control apparatus having the above arrangement according to the 11th embodiment, the dynamic monopolized section allocation request unit 4 always sets a predetermined distance (e.g., 10 km) as an allocation request range of a dynamic monopolized section. This makes it possible to simplify the apparatus on a track with simple wiring.

As described above, in addition to the same effects as those of the first embodiment, the vehicle traffic control apparatus according to this embodiment has the following effect. Since the range in which a dynamic monopolized section is requested is constant, the apparatus can be simplified.

(12th Embodiment)

A vehicle traffic control apparatus according to the 12th embodiment has the same arrangement as that of the first embodiment shown in FIG. 1. In this arrangement, the dynamic monopolized section allocation request unit 4 in FIG. 1 always sets an allocation request range of a dynamic monopolized section to be a distance that the vehicle runs in a predetermined period of time.

In the vehicle traffic control apparatus having the above arrangement according to this embodiment, the dynamic monopolized section allocation request unit 4 always sets an allocation request range of a dynamic monopolized section to be a distance that the vehicle runs in a predetermined period of time:

$$(\text{request distance})=\Sigma\{\text{train speed}\}\times(\text{unit time})\}=(\text{constant time})$$

Assume that a traffic jam occurs on a high density track. In this case, when each train requests a dynamic monopolized section in the running direction at 3-min intervals, the platform, track, and passing timing can be changed at 3-min intervals. As a consequence, flexible vehicle running can be implemented.

As described above, in addition to the same effects as those of the first embodiment, the vehicle traffic control apparatus according to the 12th embodiment has the following effect. Since an allocation request range of a dynamic monopolized section is always set to be a distance that a train runs in a predetermined period of time, flexible vehicle running changes can be made on a high density track.

(13th Embodiment)

In this embodiment, the present invention is applied to a case wherein there are a barrier and level crossing signal at a railroad crossing.

Figure 15:
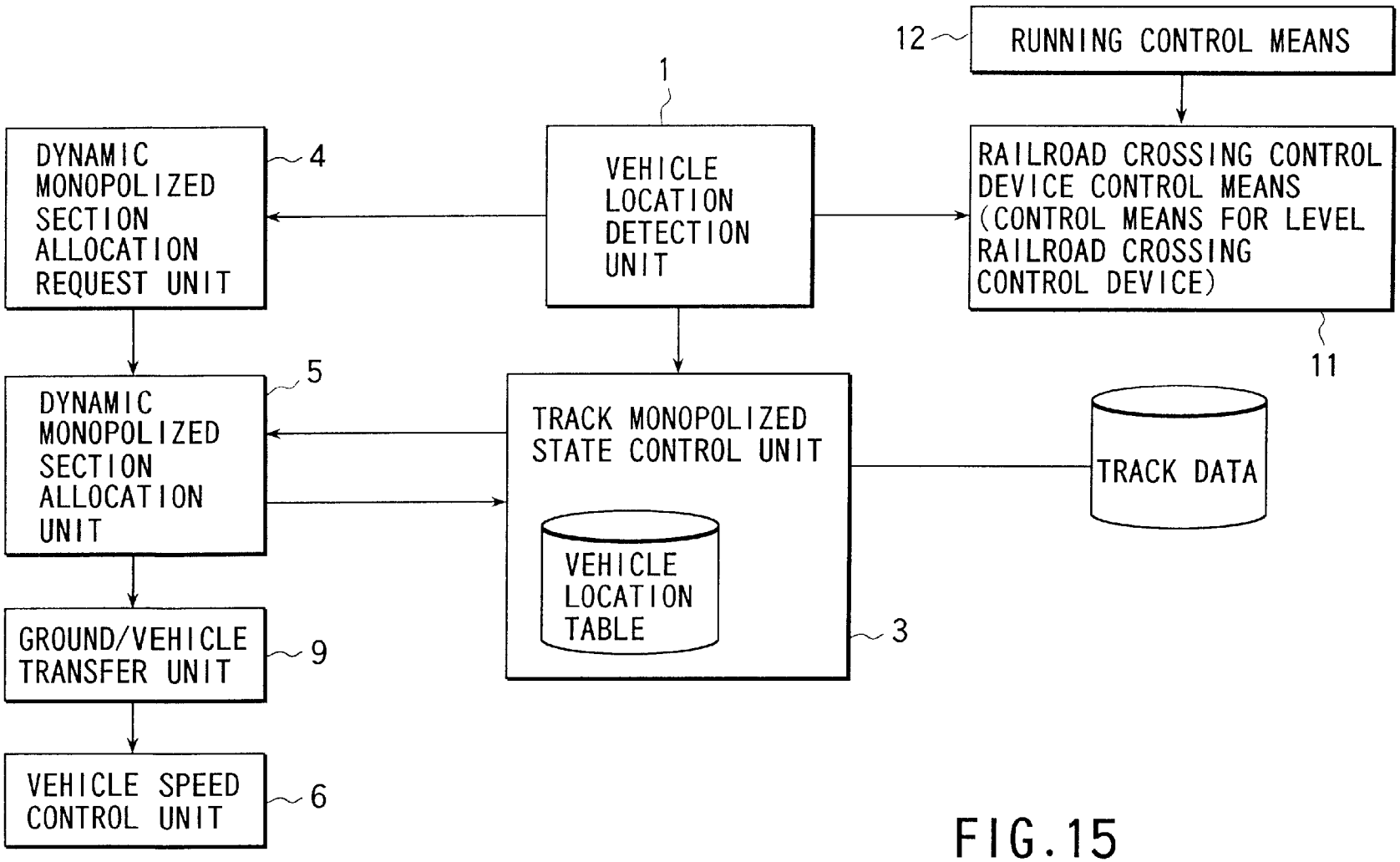
FIG. 15 is a block diagram showing a vehicle traffic control apparatus according to the 13th embodiment of the present invention.

FIG. 15 is a block diagram showing an example of the arrangement of a vehicle traffic control apparatus according to this embodiment. The same reference numerals as in FIG. 1 denote the same parts in FIG. 15, and a description thereof will be omitted, only different portions will be described below. As shown in FIG. 15, the vehicle traffic control apparatus according to this embodiment has a level railroad crossing control device 11 and running control unit 12 (corresponding to a running control unit 50 in FIG. 2) added on a vehicle in addition to the arrangement shown in FIG. 1.

The running control unit 12 controls, for example, the running of the trains 22*a*, 22*b*, and 22*c* in the running direction. The level railroad crossing control device 11 controls at least one of the barrier and level crossing signal at the railroad crossing level-crossing a track on the basis of the locations and running directions of the trains which are detected by the vehicle location detection unit 1.

Figure 16:
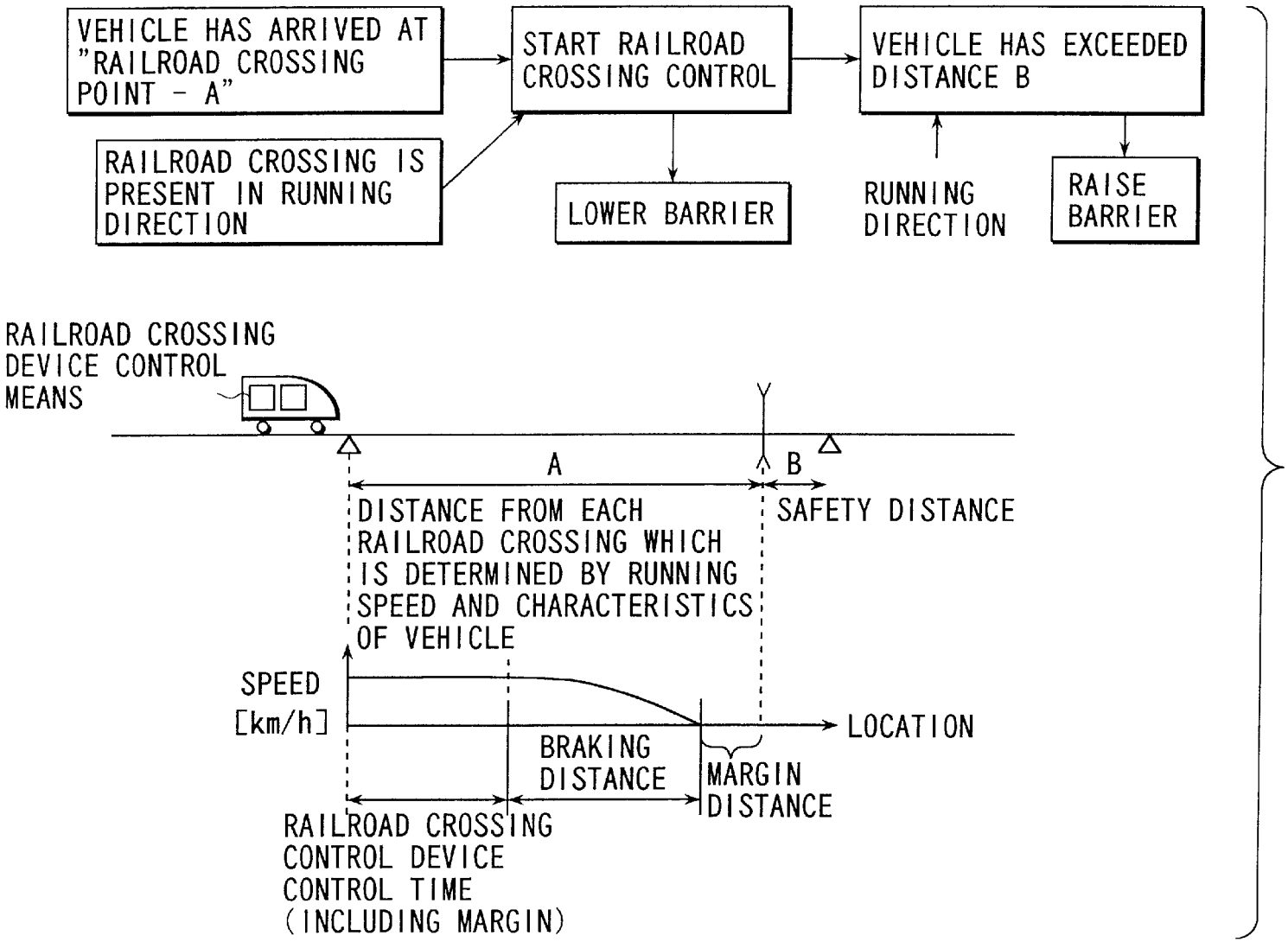
FIG. 16 is a view for explaining the operation of the vehicle traffic control apparatus according to the 13th embodiment.

The operation of the vehicle traffic control apparatus having the above arrangement according to this embodiment will be described next with reference to FIG. 16.

A description of the operations of the same components as those in FIG. 1 will be omitted, and operations of only different portions will be described below.

Referring to FIG. 15, the location of a vehicle which is detected by a vehicle location detection unit 1 is input to the level railroad crossing control device 11 on the train. The running direction of the vehicle which is controlled by the running control unit 12 is input to the level railroad crossing control device 11 on the train. When the train passes through a railroad crossing, the level railroad crossing control device 11 detects that the train has passed through a point a given distance away from the railroad crossing, and instructs a railroad crossing controller (not shown) to lower the barrier and generate an alarm. In this case, the "given distance" is determined by the following equation, and more specifically, the characteristics of the vehicle, e.g., the running speed and braking force of the train, running resistance, and operation delay, and the gradient and curvature of a track:

$$(\text{crossing location}-\text{location at which vehicle starts to pass through crossing})=(\text{running speed})\times(\text{control time of railroad crossing controller})+(\text{control distance based on current speed of vehicle})+(\text{margin distance})$$

In this case, the control time of the railroad crossing controller is the sum of a ground/vehicle transfer time, instruction recognition time of the ground-based railroad crossing controller, delay time between the instant at which an instruction is recognized and the instant at which the barrier is lowered and the level crossing signal generates an alarm, and safety margin time (e.g., two sec). For example, the margin distance is set to 100 m in consideration of a time lag of location recognition. This makes it possible to prevent collisions between trains, people, and the like which pass through and across a railroad crossing, thus ensuring safety on a track having a crossing. By changing the timing of controlling the railroad crossing controller in accordance with the speed and the like of a train, in particular, efficient running control in cooperation with other traffic systems can be realized without closing the crossing for an excessively long period of time.

As described above, in addition to the same effects as those of the first embodiment, the vehicle traffic control apparatus of this embodiment has the following effect. The barrier and level crossing signal at each railroad crossing that level-crosses a track are controlled. This makes it possible to prevent collisions between trains, people, and the like which pass through and across the railroad crossing, thus ensuring safety on the track having the crossing.

The distance between the start point of railroad crossing control and the railroad crossing point may not be calculated from moment to moment. Since each railroad crossing point is fixed, a database may be formed by storing the respective railroad crossing points and the speeds of vehicles in the form of a table in correspondence with the types of vehicles, thereby realizing a table lookup scheme of selecting a value on the safety side (larger value) as compared with the actual speed of a vehicle.

(14th Embodiment)

Figure 17:
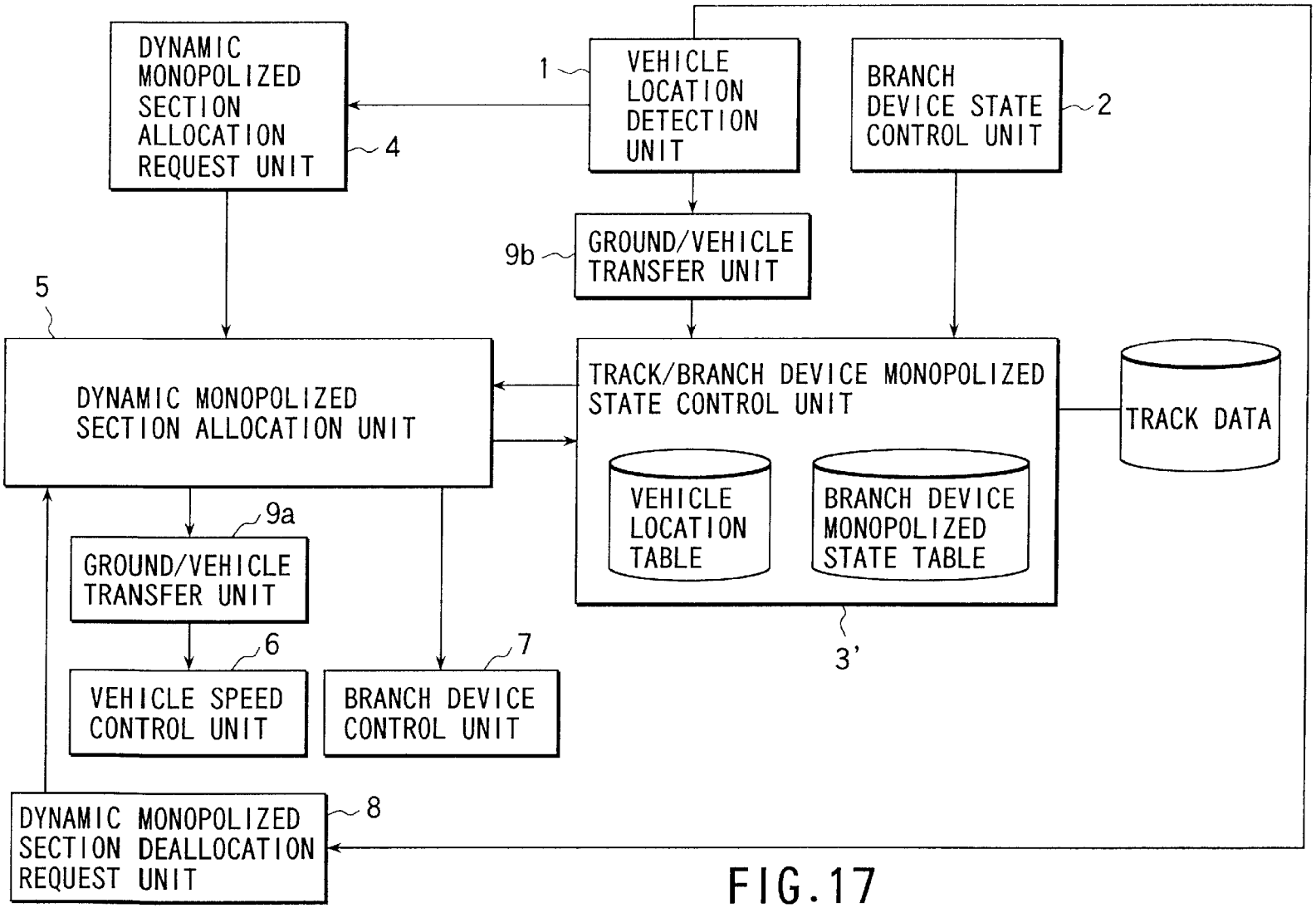
FIG. 17 is a block diagram showing a vehicle traffic control apparatus according to the 14th embodiment of the present invention.

FIG. 17 is a block diagram showing an example of the arrangement of a vehicle traffic control apparatus according to the 14th embodiment. The same reference numerals as in FIG. 9 denote the same parts in FIG. 17, and a description thereof will be omitted. Only different portions will be described below. As shown in FIG. 17, the vehicle traffic control apparatus of the 14th embodiment has a vehicle-based unit for detecting the location of a train on a track as the vehicle location detection unit 1 in FIG. 9 and also includes a ground/vehicle transfer unit 9*b*.

The ground/vehicle transfer unit 9*b* sends the location of a train, detected by the vehicle location detection unit 1, from the train to a track/branch device monopolized state control unit 3' in a ground-based device. Note that the ground/vehicle transfer unit 9*b* need not be installed independently of a ground/vehicle transfer unit 9*a* as long as bi-directional transfer can be performed.

The operation of the vehicle traffic control apparatus having the above arrangement according to the 14th embodiment will be described next.

A description of the operations of the same components as those in FIG. 9 will be omitted, and operations of only different portions will be described below.

Referring to FIG. 17, the vehicle location detection unit 1 in the 14th embodiment calculates the speed of the train by a train speed electric generator and calculates the location of the train by integrating the train speeds with time. Consider a method used for this operation. The train may cause idling and sliding. For this reason, ground-based elements may be installed at main points such as stations to receive the absolute values of train locations through communication with each ground-based element, and the vehicle location obtained by integration may be corrected. The vehicle location is transferred from the ground/vehicle transfer unit 9*b* to the track/branch device monopolized state control unit 3'.

As described above, this embodiment uses the conventional train location detection scheme, and hence need not use any new vehicle location detection unit. This makes it possible to shorten the period of time for construction.

As described above, in addition to the same effects as those of the second embodiment, the vehicle traffic control apparatus according to the 14th embodiment has the following effect. Since the location of a train is detected on the train, the arrangement of the apparatus can be simplified.

A location display and the like on a drawn track can be read by using an optical or magnetic unit instead of the ground-based element.

For example, methods of detecting the locations of vehicles include a method of using a Doppler radar type location detector, a method of calculating the location of a train by installing intersection line and counting the number of intersections, and a method of detecting the location of each vehicle by using a GPS as in an automobile navigation system.

(15th Embodiment)

Figure 18:
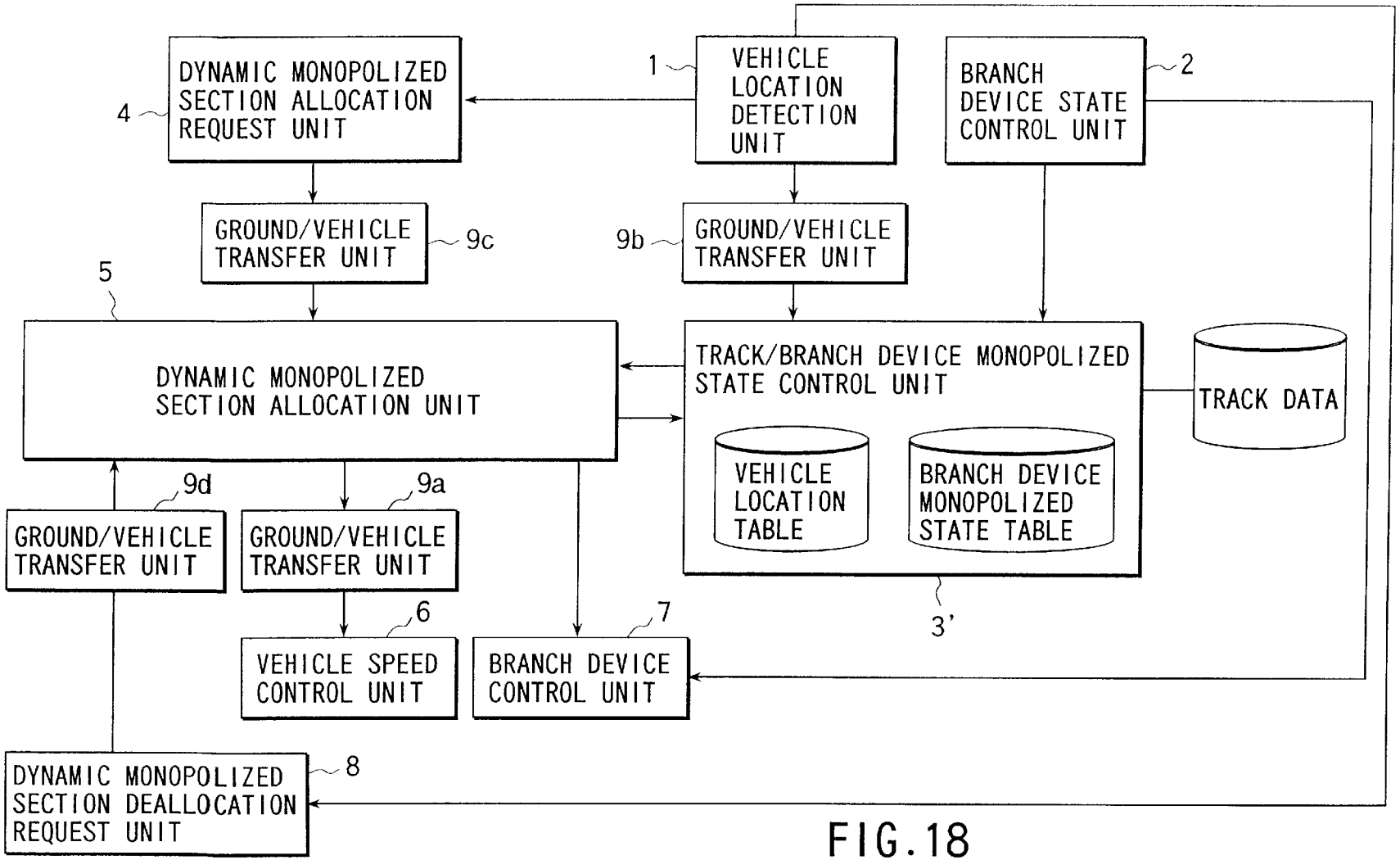
FIG. 18 is a block diagram showing a vehicle traffic control apparatus according to the 15th embodiment of the present invention.

FIG. 18 is a block diagram showing an example of the arrangement of a vehicle traffic control apparatus according to the 15th embodiment. The same reference numerals as in FIG. 9 denote the same parts in FIG. 15, and a description thereof will be omitted. Only different portions will be described below. In the vehicle traffic control apparatus according to the 15th embodiment, as shown in FIG. 18, a dynamic monopolized section allocation request unit 4 and dynamic monopolized section deallocation request unit 8 respectively make a dynamic monopolized section allocation request and dynamic monopolized section deallocation request on the train. This embodiment also has a ground/vehicle transfer unit 9*c* and ground/vehicle transfer unit 9*d*.

The ground/vehicle transfer unit 9*c* transfers the dynamic monopolized section allocation request from the train to a dynamic monopolized section allocation unit 5.

The operation of the vehicle traffic control apparatus having the above arrangement according to this embodiment will be described next. A description of the operations of the same components as those in FIG. 9 will be omitted, and operations of only different portions will be described below.

Referring to FIG. 18, when a train location is detected on the train, a dynamic monopolized section allocation request and dynamic monopolized section deallocation request are made on the train, and the requests are transferred from the ground/vehicle transfer units 9*c* and 9*c* to the dynamic monopolized section allocation unit 5. With this operation, when there are many trains to be subjected to running control, the processing amount in a ground-based device does not increase, and the processing load can be shared among the ground-based device and the train.

In addition, each train can operate in accordance with its attributes and characteristics, and data dependent on each train may be held therein. This makes it possible to reduce the size of the ground-based device.

As described above, in addition to the same effects as those of the second embodiment, the vehicle traffic control apparatus according to the 15th embodiment has the following effect. Since dynamic monopolized section allocation and deallocation requests are made on the basis of the location of each train which is detected on the train, autonomous decentralization type running control on trains can be performed by the trains themselves.

In the third to 13th embodiments, the present invention is applied to the form of the first embodiment. However, the present invention is not limited to this. The same functions and effects as those described above can also be obtained by applying the third to 13th embodiments to the second embodiment.

In the first to 15th embodiments, the present invention is applied to trains as vehicles. However, the present invention is not limited to this. For example, the same functions and effects as those described above can also be obtained by applying the present invention to monorails, automobiles, buses, and tracks as vehicles.

As has been described above, the vehicle traffic control apparatus of the present invention can realize high-density, efficient vehicle running operation with a reduction in cost while securing safety by preventing accidents between stations and within stations, e.g., vehicle-vehicle collision, vehicle-vehicle contact, bumping, derailment, turnover, railroad crossing disasters, and also preventing accesses of trains to no-accessing sections in a running system for vehicles that run on a track, e.g., a train railway system or new traffic system.

Additional advantages and modifications will readily occur to those skilled in the art. Therefore, the invention in its broader aspects is not limited to the specific details and representative embodiments shown and described herein.

Accordingly, various modifications may be made without departing from the spirit or scope of the general inventive concept as defined by the appended claims and their equivalents.

What is claimed is:

1. A vehicle traffic control apparatus for performing running control and traveling control on vehicles that run on a track, comprising:

a vehicle location detection unit configured for detecting locations of the vehicles on the track;

a control unit configured for storing and controlling a monopolized state of the track which is monopolized by the vehicles;

an allocation request unit configured for requesting allocation of a dynamic monopolized section as a range, in which each vehicle can freely run in both inbound and outbound directions, on the basis of the locations of the vehicles which are detected by said vehicle location detection unit;

an allocation unit configured for inquiring of said control unit as to the allocation of the dynamic monopolized section to each vehicle, which is requested by said allocation request unit, to perform collating operation, executing actual allocation of dynamic monopolized sections on the basis of a collation result, causing said control unit to store an allocation result, and outputting the allocation result;

a transfer unit configured for transferring the dynamic monopolized sections allocated by said allocation unit to the respective vehicles; and a vehicle speed control unit configured for performing speed control on the vehicles in accordance with the allocated dynamic monopolized sections transferred by said transfer unit.

2. An apparatus according to claim 1, which further comprises a running diagram input unit configured for inputting a vehicle running diagram, and wherein said allocation request unit determines an allocation request range of a dynamic monopolized section by using the vehicle running diagram input by said running diagram input unit.

3. An apparatus according to claim 1, further comprising a deallocation request unit configured for determining a range of a dynamic monopolized section which is located behind each vehicle and deallocated as the vehicle runs, together with a deallocation timing, on the basis of the location of each vehicle which is detected by said vehicle location detection unit, and requesting said allocation unit to deallocate the dynamic monopolized section when an initial running plan is changed because of an accident.

4. An apparatus according to claim 3, wherein said deallocation request unit sets a timing of deallocating a dynamic monopolized section to be the same as a timing of requesting allocation of a dynamic monopolized section.

5. A vehicle traffic control apparatus according to claim 1, wherein said vehicle speed control unit has a function of forming a deceleration curve from an end position of a dynamic monopolized section (end point of a vehicle in a running direction) to a start position of the dynamic monopolized section in consideration of performance of the vehicle and linearity of a track, and automatically adjusting a speed of the vehicle to make the vehicle decelerate along the deceleration curve.

6. An apparatus according to claim 1, further comprising a vehicle location error correction unit configured for detecting locations of depots scattered on the track, measuring an error between the detected located and an actual location, and correcting the location of the vehicle which is detected by said vehicle location detection unit.

7. An apparatus according to claim 1, further comprising dynamic monopolized section manually setting unit configured for manually setting a section to which accesses of vehicles are to be inhibited.

8. A vehicle traffic control apparatus according to claim 1, wherein said allocation unit performs allocation in consideration of not only dynamic monopolized sections that have already been allocated to other vehicles but also information from a running obstacle detection device, railroad crossing control device, and rail closing control device, said running obstacle detection device being arranged along a railroad and including an amount-of-rainfall detector, fallen stone detector, obstacle detector.

9. An apparatus according to claim 1, wherein said allocation request unit sets a maximum allocation request range of a dynamic monopolized section up to a next depot at which a vehicle stops.

10. An apparatus according to claim 1, wherein said allocation request unit always sets a predetermined distance as an allocation request range of a dynamic monopolized section.

11. An apparatus according to claim 1, wherein said allocation request unit always sets a distance that the corresponding vehicle runs in a predetermined period of time as an allocation request range of a dynamic monopolized section.

12. An apparatus according to claim 1, further comprising a level railroad crossing control device which is set on a vehicle and controls at least one of a barrier and level crossing signal at a railroad crossing which level-crosses the track on the basis of the location and running direction of each vehicle which is detected by said vehicle location detection unit.

13. A vehicle traffic control apparatus for performing running control and traveling control on vehicles that run on a track having a branch, comprising:

a vehicle location detection unit configured for detecting locations of the vehicles on the track;

a first control unit configured for controlling a joining direction of a branch device installed at a branch point on the track and a state of the branch device whose direction is being changed or fixed;

a second control unit configured for storing and controlling a monopolized state of the track which is monopolized by the vehicles and a monopolized state of the branch device;

an allocation request unit configured for requesting allocation of a dynamic monopolized section as a range in which each vehicle can freely run in both inbound and outbound directions and allocation of the branch device on the basis of the locations of the vehicles, which are detected by said vehicle location detection unit, and the state of the branch device, which is controlled by said first control unit;

an allocation unit configured for inquiring of said second control unit as to the allocation of the dynamic monopolized section and the branch device to each vehicle, which is requested by said allocation request unit, to perform collating operation, executing actual allocation of a dynamic monopolized section and branch device to each vehicle on the basis of a collation result, causing said second control unit to store an allocation result, and outputting the allocation result;

a transfer unit configured for transferring the dynamic monopolized sections allocated by said allocation unit to the respective vehicles;

a vehicle speed control unit configured for performing speed control on the vehicles in accordance with the allocated dynamic monopolized sections transferred by said transfer unit; and a control unit configured for changing and fixing a joining direction of the branch device allocated by said allocation unit.

14. An apparatus according to claim 13, which further comprises a running diagram input unit configured for inputting a vehicle running diagram, and wherein said allocation request unit determines an allocation request range of a dynamic monopolized section by using the vehicle running diagram input by said running diagram input unit.

15. An apparatus according to claim 13, further comprising a deallocation request unit configured for determining a range of a dynamic monopolized section which is located behind each vehicle and deallocated as the vehicle runs, together with a deallocation timing, on the basis of the location of each vehicle which is detected by said vehicle location detection unit, and requesting said allocation unit to deallocate the dynamic monopolized section when an initial running plan is changed because of an accident.

16. An apparatus according to claim 15, wherein said deallocation request unit sets a timing of deallocating a dynamic monopolized section to be the same as a timing of requesting allocation of a dynamic monopolized section.

17. A vehicle traffic control apparatus according to claim 13, wherein said vehicle speed control unit has a function of forming a deceleration curve from an end position of a dynamic monopolized section which corresponds to an end point of a vehicle in a running direction to a start position of the dynamic monopolized section in consideration of performance of the vehicle and linearity of a track, and automatically adjusting a speed of the vehicle to make the vehicle decelerate along the deceleration curve.

18. An apparatus according to claim 13, further comprising a vehicle location error correction unit configured for detecting locations of depots scattered on the track, measuring an error between the detected located and an actual location, and correcting the location of the vehicle which is detected by said vehicle location detection unit.

19. An apparatus according to claim 13, further comprising dynamic monopolized section manually setting unit configured for manually setting a section to which accesses of vehicles are to be inhibited.

20. A vehicle traffic control apparatus according to claim 13, wherein said allocation unit performs allocation in consideration of not only dynamic monopolized sections that have already been allocated to other vehicles but also information from a running obstacle device, railroad crossing control device, and rail closing control device, said running obstacle device being arranged along a railroad and including an amount-of-rainfall detector, fallen stone detector, obstacle detector.

21. An apparatus according to claim 13, wherein said allocation request unit sets a maximum allocation request range of a dynamic monopolized section up to a next depot at which a vehicle stops.

22. An apparatus according to claim 13, wherein said allocation request unit always sets a predetermined distance as an allocation request range of a dynamic monopolized section.

23. An apparatus according to claim 13, wherein said allocation request unit always sets a distance that the corresponding vehicle runs in a predetermined period of time as an allocation request range of a dynamic monopolized section.

24. An apparatus according to claim 13, further comprising a level railroad crossing control device which is set on a vehicle and controls at least one of a barrier and level crossing signal at a railroad crossing which level-crosses the track on the basis of the location and running direction of each vehicle which is detected by said vehicle location detection unit.

25. An apparatus according to claim 13, wherein said vehicle location detection unit detects, on a vehicle, a location of the vehicle within a track, and further comprises a second transfer unit configured for transferring and inputting the location of the vehicle which is detected by said vehicle location detection unit from the vehicle to said second control unit.

26. An apparatus according to claim 25, further comprising a second transfer unit configured for transferring and inputting, from the vehicle to said allocation unit, a dynamic monopolized section allocation request from said allocation request unit and a dynamic monopolized section deallocation request from said deallocation request unit on the basis of the location of each vehicle which is detected by said vehicle location detection unit in order to generate the dynamic monopolized section allocation request and dynamic monopolized section deallocation request on the vehicle.

27. A vehicle traffic control method of performing running control and traveling control on vehicles that run on a track, comprising the steps of:

detecting locations of the vehicles on the track;

storing a monopolized state of the track which is monopolized by the vehicles in a memory and managing it;

requesting allocation of a dynamic monopolized section as a range, in which each vehicle can freely run in both inbound and outbound directions, on the basis of the locations of the vehicles which are detected by said vehicle location detection step;

inquiring of said control unit as to the allocation of the dynamic monopolized section to each vehicle, which is requested by said allocation request step, to perform collating operation, executing actual allocation of dynamic monopolized sections on the basis of a collation result; storing an allocation result in said memory;

transferring the dynamic monopolized sections allocated by said allocation step to the respective vehicles; and performing speed control on the vehicles in accordance with the allocated dynamic monopolized sections transferred by said transfer step.

28. A vehicle traffic control method of performing running control and traveling control on vehicles that run on a track having a branch, comprising the steps of:

detecting locations of the vehicles on the track;

controlling a joining direction of a branch device installed at a branch point on the track and a state of the branch device whose direction is being changed or fixed;

storing and controlling a monopolized state of the track which is monopolized by the vehicles and a monopolized state of the branch device;

requesting allocation of a dynamic monopolized section as a range in which each vehicle can freely run in both inbound and outbound directions and allocation of the branch device on the basis of the locations of the vehicles, which are detected by said vehicle location detection step, and the state of the branch device, which is controlled by said step of controlling a joining direction;

inquiring of said memory as to the allocation of the dynamic monopolized section and the branch device to each vehicle, which is requested by said allocation request step, to perform collating operation, executing actual allocation of a dynamic monopolized section and branch device to each vehicle on the basis of a collation result;

storing an allocation result;

transferring the dynamic monopolized sections allocated by said allocation step to the respective vehicles;

performing speed control on the vehicles in accordance with the allocated dynamic monopolized sections transferred by said transfer step; and changing and fixing a joining direction of the branch device allocated by said allocation step.

* * * * *